US011359564B2

(12) United States Patent
Shaver et al.

(10) Patent No.: US 11,359,564 B2
(45) Date of Patent: Jun. 14, 2022

(54) IMPLEMENTING VARIABLE VALVE ACTUATION ON A DIESEL ENGINE AT HIGH-SPEED IDLE OPERATION FOR IMPROVED AFTERTREATMENT WARM-UP

(71) Applicant: Purdue Research Foundation, West Lafayette, IN (US)

(72) Inventors: Gregory M. Shaver, Lafayette, IN (US); Kalen Vos, Albuquerque, NM (US); Mrunal Joshi, Columbus, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 17/217,369

(22) Filed: Mar. 30, 2021

(65) Prior Publication Data

US 2021/0301742 A1 Sep. 30, 2021

Related U.S. Application Data

(60) Provisional application No. 63/001,568, filed on Mar. 30, 2020.

(51) Int. Cl.

| | |
|---|---|
| ***F02D 13/02*** | (2006.01) |
| ***F02D 31/00*** | (2006.01) |
| ***F02D 41/00*** | (2006.01) |
| ***F02D 41/02*** | (2006.01) |
| ***F02D 41/06*** | (2006.01) |

(52) U.S. Cl.

CPC ..... *F02D 41/0245* (2013.01); *F02D 13/0249* (2013.01); *F02D 31/001* (2013.01); *F02D 41/064* (2013.01); *F01N 2430/10* (2013.01); *F02D 41/006* (2013.01); *F02D 2200/0802* (2013.01)

(58) Field of Classification Search

CPC .. F02D 13/0249; F02D 31/001; F02D 41/006; F02D 41/0245; F02D 41/064; F02D 2200/0802; F01N 2430/10

See application file for complete search history.

(56) References Cited

U.S. PATENT DOCUMENTS 7,854,114 B2 12/2010 England
2006/0130459 A1* 6/2006 Warner ..... F01N 3/0231 60/286

(Continued)

OTHER PUBLICATIONS

Kalen R. Vos, Utilizing Valvetrain Flexibility To Influence Gas Exchange and Reduce Reliance on Exhaust Manifold Pressure Control for Efficient Diesel Engine Operation, Purdue University, Aug. 2019 (Year: 2019).*

(Continued)

*Primary Examiner* — Audrey B. Walter

(74) *Attorney, Agent, or Firm* — Woodard, Emhardt Henry, Reeves & Wagner, LLP

(57) ABSTRACT

Increasing engine idle speed, combined with modulating the timing of the exhaust valve during idling, increases heat transfer from the engine to aftertreatment systems to reduce the time required for the aftertreatment system to reach a minimum temperature for efficient operation. The resultant increases in heat transfer include an increase of at least 30% in the flow rate of exhaust gases and an increase of exhaust temperature by at least 25° C.

21 Claims, 19 Drawing Sheets

(56) References Cited

U.S. PATENT DOCUMENTS

2008/0086257 A1* 4/2008 Iihoshi ..... F02D 41/1495
701/105
2011/0203272 A1* 8/2011 Nedorezov ..... F02P 5/1502
60/611
2015/0322879 A1* 11/2015 Zeng ..... F02D 41/30
701/103
2016/0123200 A1* 5/2016 Ramappan ..... F02D 37/02
60/285
2017/0122139 A1* 5/2017 Kaneko ..... F01L 1/3442

OTHER PUBLICATIONS

Charlton, et al., Meeting the US Heavy-Duty EPA 2010 Standards and Providing Increased Value for the Customer, Oct. 5, 2010, SAE International, 2010-01-1934 (pp. 10).
Chen et al., Control-oriented model for integrated diesel engine and aftertreatment systems thermal management, Control Engineering Practice, 22:81-93, 2014.
Chen, et al., Estimation and adaptive nonlinear model predictive control of selective catalytic reduction systems in automotive applications, Feb. 26, 2016, Journal of Process Control 40:78-92, 2016.
Ding, et al., Fuel efficient exhaust thermal management for compression ignition engines during idle via cyclinder deactivation and flexible valve actuation, International Journal of Engine Research, 2016 vol. 17(6) 619-630.
Gehrke, et al., Investigation of VVA-Based Exhaust Management Strategies gy Means of a HD Single Cylinder Research Engine and Rapid Prototyping Systems, Apr. 8, 2013, SAE International 2013-01-0587 (pp. 15).
Gosala, et al., Diesel engine aftertreatment warm-up through early exhaust valve opening and internal exhaust gas recirculation during idle operation, International Journal of Engine Research, 2018, vol. 19(7) 758-773.
Hou, et al., Research on Temperature Characteristics of DPF Regeneration Technology Based on Catalytic Combustion of Fuel Injection, In Power and Energy Engineering Conference (APPEEC), 2010 Asia-Pacific, (pp. 4).
Joshi, et al., Reducing Diesel Engine Drive Cycle Fuel Consumption through Use of Cylinder Deactivation to Maintain Aftertreatment Component Temperature during Idle and Low Load Operating Conditions, Frontiers In Mechanical Engineering, 2017, doi: 10.3389/fmech.2017.00008.
Ramesh, et al., Cylinder Deactivation for Increased Engine Efficiency and Aftertreatment Thermal Management in Diesel Engines, Apr. 3, 2018, SAE International 2018-01-0384 (pp. 10).
Ramesh, et al., Reverse breathing in diesel engines for aftertreatment thermal management, International Journal of Engine Research, 2019, vol. 20(8-9) 862-876.
Salehi, et al., Optimal Exhaust Valve Opening Control for Fast Aftertreatment Warm Up in Diesel Engines, Proceedings of the ASME 2018, Dynamic Systems and Control Conference, DSCC2018, Sep. 30-Oct. 3, 2018, Atlanta, GA (pp. 9).
Sharp, et al., Achieving Ultra Low NOX Emissions Levels with a 2017 Heavy-Duty On-Highway TC Diesel Engine—Comparison of Advanced Technology Approaches, SAE International, doi: 10,4271/2017-01-0956 (pp. 14).
Sharp, et al., Evaluating Technologies and Methods to Lower Nitrogen Oxide Emissions from Heavy-Duty Vehicles; Apr. 2017, SwRI Project 19503, California Air Resources Board (pp. 403).
Song, et al., Experimental and Modeling Study of a Diesel Oxidation Catalyst (DOC) under Transient and CPF Active Regeneration Conditions, Apr. 8, 2013, SAE International, 2013-01-1046 (pp. 14).
Stadlbauer, et al., DOC Temperature Control for Low Temperature Operating Ranges with Post and Main Injection Actuation, Apr. 8, 2013, SAE International, 2013-01-1580 (pp. 10).
Stanton, Donald W., Systematic Development of Highly Efficient and Clean Engines to Meet Future Commercial Vehicle Greenhouse Gas Regulations, 2013 L. Ray Buckendale Lecture, SAE International, 2013-01-2421 (pp. 94).
US EPA, Heavy-Duty Highway Compression-Ignition Engines and Urban Buses: Exhaust Emission Standards, EPA-420-B-16-018, Mar. 2016 (pp. 2).
Vos, et al., Impact of Cylinder Deactivation and Cylinder Cutout via Flexible Valve Actuation on Fuel Efficient Aftertreatment Thermal Management at Curb Idle, Frontiers in Mechanical Engineering, Aug. 21, 2019, mech 2019.00052 (pp. 16).

* cited by examiner (20 minute hot soak between Cold Cycle and Hot Cycle)

(20 minute hot soak between Cold Cycle and Hot Cycle)

Table 1

| | TM Cal. w/o VVA at 800 RPM | TM Cal. w/o VVA at 1000 RPM | TM Cal. w/o VVA at 1200 RPM | EEVO+ iEGR at 800 RPM | EEVO at 1000 RPM | EEVO at 1200 RPM | LEVO at 800 RPM | LEVO at 1000 RPM | LEVO (v1) at 1200 RPM | LEVO (v2) at 1200 RPM |
|---|---|---|---|---|---|---|---|---|---|---|
| LVO timing (relative to Baseline) | Baseline | Baseline | Baseline | 60 CAD advanced | 30 CAD advanced | 45 CAD delayed | 135 CAD delayed | 80 CAD delayed | 80 CAD delayed | 100 CAD delayed |
| Better warm-up performance | Baseline | ✓ | ✓ | Similar | ✓ | ✓ | ✓ | ✓ | ✓ | ✓ |
| Lower fuel flow rate | Baseline | ✗ | ✗ | ✓ | ✗ | ✗ | ✗ | ✗ | ✗ | ✗ |
| Lower engine-out NOx flow rate | Baseline | ✓ | ✓ | ✓ | Similar | ✓ | Similar | ✓ | ✓ | ✓ |
| Lower engine-out PM flow rate | Baseline | ✓ | ✓ | ✓ | ✓ | ✓ | Similar | Similar | ✓ | ✓ |

Fig. 16

IMPLEMENTING VARIABLE VALVE ACTUATION ON A DIESEL ENGINE AT HIGH-SPEED IDLE OPERATION FOR IMPROVED AFTERTREATMENT WARM-UP

CROSS-REFERENCE TO RELATED APPLICATIONS

This application claims the benefit of U.S. Provisional Application No. 63/001,568 filed Mar. 30, 2020, which is hereby incorporated by reference.

BACKGROUND

Emissions regulations have influenced the progression of technology for diesel engines. Currently, U.S. tailpipe emissions for on-highway medium- to heavy-duty diesel engines are required to have emissions equal to, or lower than, 0.2 g/hp-hr oxides of nitrogen (NOx), 0.01 g/hp-hr of particulate matter (PM), and 0.14 g/hp-hr of unburnt hydrocarbons (UHC) [1].

U.S. emissions regulations set in the year 2007 have since then required diesel engines to utilize exhaust aftertreatment systems to maintain compliant performance with the EPA standards [2]. Exhaust aftertreatment systems generally contain three major components: a diesel oxidation catalyst (DOC), a diesel particulate filter (DPF), and a selective catalytic reduction (SCR) system. See FIG. 1, which shows a representation of a typical aftertreatment hardware arrangement for a diesel engine. Engine-out UHC and carbon monoxide are oxidized in the DOC. The DPF traps engine-out PM and the SCR reduces engine-out NOR. Efficient exhaust aftertreatment operation demands elevated temperatures, normally exceeding 250° C. [3-9].

Previous studies have demonstrated the ability to raise exhaust temperatures for more efficient aftertreatment thermal management by utilizing various strategies such as maximally closing a variable geometry turbine (VGT), cylinder deactivation (CDA), intake valve modulation, and exhaust valve modulation [2, 10-17]. Southwest Research Institute's effort with the California Air Resource Board has demonstrated a ~6 kW increase in exhaust energy by elevating the unloaded idle speed from 550 RPM to 1000 RPM on a heavy-duty diesel engine equipped with a fixed geometry turbocharger and a turbo-compounder. Specifically, this improvement in exhaust energy was enabled by a ~40% increase in exhaust flow and a ~50° C. increase in the temperature leaving the turbo-compounder, relative to a baseline thermal management unloaded idle calibration [18, 19]. Applicants have determine that for the same thermal calibration strategy, increasing the idle speed from 550 RPM to 1000 RPM over the first 525 seconds of the Heavy Duty Federal Test Procedure resulted in improved cumulative exhaust energy while realizing higher cumulative NOx and PM emissions exiting the turbo-compounder [18, 19].

Presently, the thermal management merits for combining high speed idle operation with a flexible valvetrain have not been demonstrated experimentally on a multi-cylinder diesel engine. We have determined, however, that high speed idle, with or without exhaust valve opening (EVO) modulation, can significantly improve aftertreatment "warm-up" performance while emitting engine-out NOx and PM levels equal to, or better than, a state-of-the-art thermal calibration on a Clean Idle Certified engine.

BRIEF DESCRIPTION OF THE DRAWINGS

FIG. 6. Valve profiles for the tested strategies are shown, where (a) corresponds to conventional operation, (b)-(d) corresponds to EEVO operation, and (e)-(h) corresponds to LEVO operation.

FIGS. 7 (*c*), (*d*), and (*e*) correspond to the EGR fraction, air-to-fuel ratio, and the turbine outlet temperature for the tested strategies.

FIG. 9(*b*) is a Log P-Log V diagram for the strategies tested at 800 RPM. FIG. 9 (*c*) Log P-Log V diagram for the strategies tested at 1000 RPM. FIG. 9 (*d*) Log P-Log V diagram for the strategies tested at 1200 RPM.

FIG. 13 (*c*) is a heat transfer rate diagram for the strategies tested at 1000 RPM and compared against the baseline. FIG. 13 (*d*) is a heat transfer rate diagram for the strategies tested at 1200 RPM and compared against the baseline. Heat transfer rate was calculated using Equation 1.

FIG. 16 shows Table 1 that quantifies the EVO timing for the tested strategies and compares "warm-up" thermal management performance, fuel efficiency, and emissions to the curb idle baseline.

DESCRIPTION

Aftertreatment systems require elevated temperatures to operate effectively. Fuel-efficient low load operation, which includes curb idle, generally does not allow engine-out temperatures to be high enough to support effective aftertreatment operation. As a result, engine thermal calibrations are utilized to enable higher engine-out temperatures for effective aftertreatment operation. The engine utilizes a thermal calibration at idle to achieve engine-out temperatures of ~257° C., which is nearly 115° C. warmer than the fuel-efficient idle calibration.

Achieving elevated aftertreatment temperatures often requires a "warm-up" period, in which the aftertreatment system is initially too cold to effectively reduce engine-out emissions. This "warm-up" period requires positive exhaust gas-to-catalyst heat transfer to increase the aftertreatment catalyst temperatures. Conversely, a warmed-up aftertreatment system prefers minimal catalyst-to-exhaust gas heat transfer to prevent undesirable cooling (i.e. "stay warm" performance).

Existing on-road diesel engines have set idle speeds and exhaust valve openings to provide desired operating characteristics. In accordance with these prior practices, an on-road diesel engine is idled at about 750-850 RPMs. At lower speeds such as 600-700 RPMs, there can be excessive driveline vibration. Higher idle speeds are considered in appropriate due to the resulting increase in fuel consumption and emissions. It has been unexpectedly found that idling an on-road diesel engine at 1,000 RPMs or higher provides improved warm up of the aftertreatment system and enhances overall operation of the diesel engine. Similarly, in accordance with prior practices, an on-road diesel engine typically has an exhaust valve opening at 130-150 crank angle degrees after top dead center.

Figure 1:
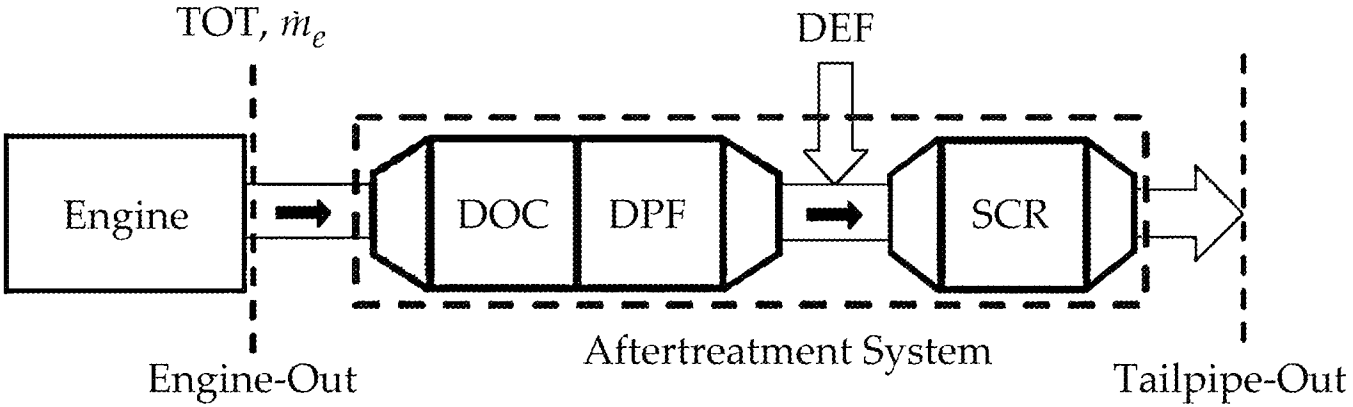
FIG. 1 is a diagram showing a representation of a typical aftertreatment hardware arrangement for a diesel engine as used in this disclosure.

The following equation approximates the exhaust gas-to-catalyst heat transfer rate:

$$\dot{q} \approx C_p \dot{m}_e^{4/5}(\mathrm{TOT} - T_{catalyst}), \tag{1}$$

where $\dot{q}$ is the heat rate, $C_p$ is the heat capacity, $\dot{m}_e$ is the exhaust flow, $T_{catalyst}$ is the catalyst temperature, and TOT is the turbine outlet temperature. FIG. 1 shows a representation of a typical aftertreatment hardware arrangement for a diesel engine as used in this disclosure. This equation applies to the arrangement in FIG. 1, where the aftertreatment is treated as a lumped system at a uniform temperature $T_{catalyst}$.

This simplified model illustrates how engine-out exhaust flow ($\dot{m}_e$) and TOT can impact the thermal management of the aftertreatment system via the exhaust gas-to-catalyst heat transfer rate. Specifically, there is a positive heat transfer rate to the aftertreatment system so long as $(\mathrm{TOT} - T_{catalyst}) > 0$, resulting in "warm-up" performance. This "warm-up" performance can be further improved by elevating exhaust flow rates and TOTs.

The disclosure is focused on improving the "warm-up" phase. Higher exhaust flow rates and temperatures are targeted by increasing the engine's idle speed, while maintaining the same idle torque. The engine's stock idle operation is 800 RPM, 1.3 bar BMEP, whereas the elevated idle conditions of interest are 1000 RPM, 1.3 bar BMEP, and 1200 RPM, 1.3 bar BMEP.

In addition to high idle speeds, EVO modulation is utilized to further increase the engine-out temperatures by varying the duration and lift of the exhaust profile. In this effort, both late EVO and early EVO are demonstrated.

Early exhaust valve opening (EEVO) forces an early blow-down of the exhaust gas during the expansion stroke, resulting in reduced engine efficiency by decreasing the effective expansion ratio (EER). As a result, an increase in fueling is required during EEVO operation, enabling higher engine-out temperatures for improved "warm-up" performance [13, 16, 20].

Late exhaust valve opening (LEVO) reduces both the duration and lift of the exhaust profile, which forces the engine to work harder to pump gases from the cylinder into the exhaust manifold through a smaller opening. This enables higher exhaust temperatures as a result of increased fueling [12, 20].

EEVO and LEVO at high idle speeds are capable of enabling emission-constrained, elevated engine-out temperatures and mass flows for improved aftertreatment "warm-up" performance.

Application for High Speed Idle Strategies

Figure 2A:
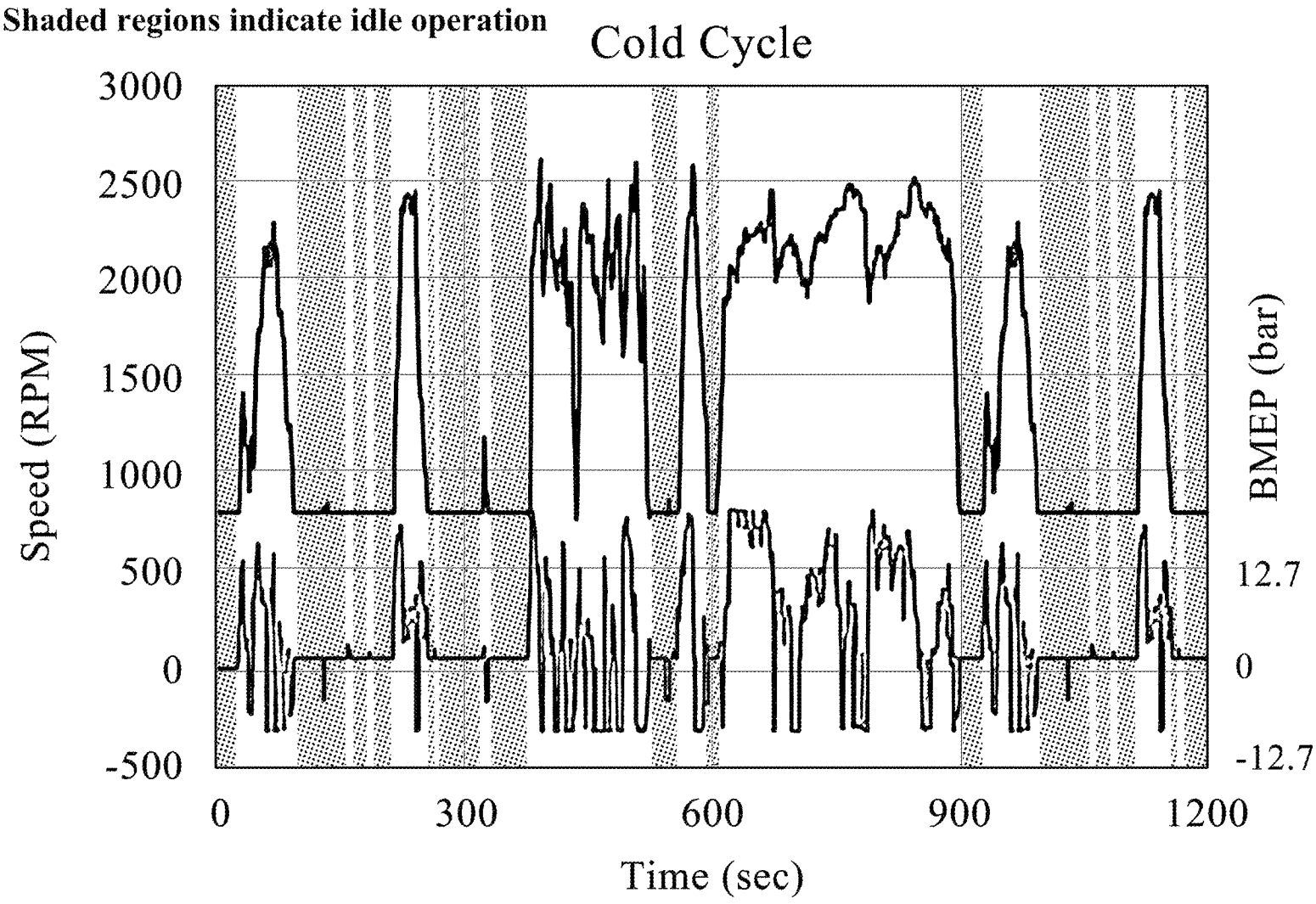
FIG. 2. includes tables showing the speed (RPM) load (BMEP) space corresponding to the engine used in this effort during the HDFTP drive cycle.
Figure 2B:
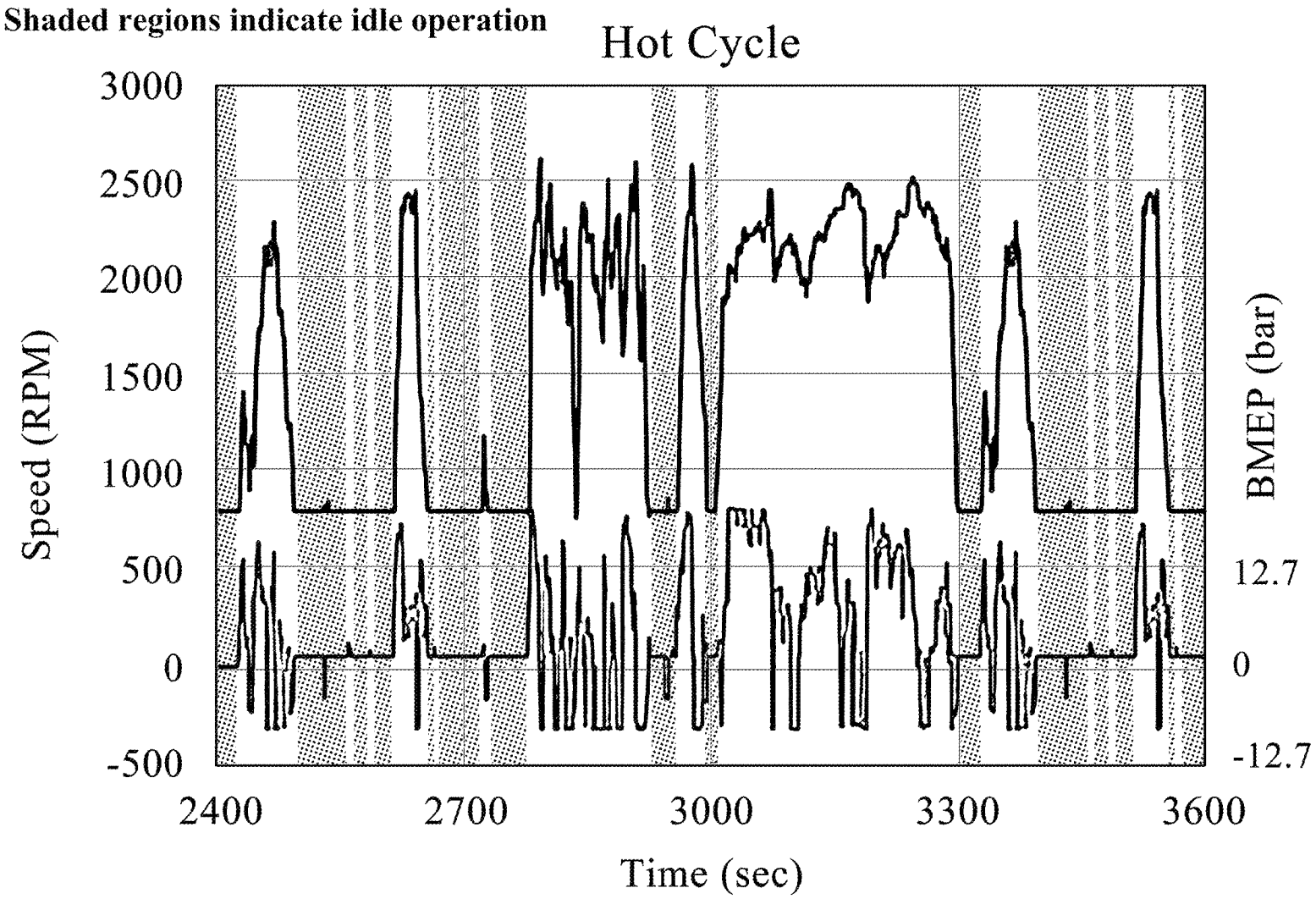

The heavy duty federal test procedure (HDFTP) consists of a cold-start cycle, followed by a 20 minute soak period, and concludes with a hot-start cycle. FIG. 2 illustrates the engine speed and torque profiles corresponding to the engine used for the complete HDFTP drive cycle. As shown, ~44% of the HDFTP is spent in idle operation (800 RPM and 1.3 bar BMEP), per the shaded regions in FIG. 2. During the cold-cycle, the idle portions generally contribute to aftertreatment "warm-up" performance, as the aftertreatment system is initially at ambient temperature for the beginning of this cycle. During the hot-cycle, the idle portions generally contribute to aftertreatment "stay-warm" performance, as the aftertreatment system is initially warm at the beginning of this cycle. However, during the hot-cycle, idle operations can result in cooling down the aftertreatment system if the turbine out temperature is too low. As a result, idle operation has significant relevance for aftertreatment thermal management.

Methodology for Efficiency Analysis

The performance of the tested strategies are compared using the engine cycle efficiencies to understand the gas exchange, the energy conversion, and the parasitic losses throughout the four strokes of the diesel cycle. Open, closed, and mechanical efficiency are the primary cycle efficiencies that constitute the brake thermal efficiency (BTE) of the engine, per Equation 2 [2].

$$\mathrm{BTE} = \mathrm{OCE} \times \mathrm{CCE} \times \mathrm{ME}. \tag{2}$$

Open cycle efficiency (OCE) quantifies the effectiveness of in-cylinder gas exchange. Closed cycle efficiency (CCE) quantifies the effectiveness of converting fuel-energy to piston-work, which is generally degraded by a delayed heat release and in-cylinder heat transfer. Mechanical efficiency (ME) quantifies the effect of friction and the parasitic losses from engine loads.

BTE and brake specific fuel consumption (BSFC) are related by Equation 3, where ($LHV_{fuel}$) is the lower heating value of the fuel. As a result, each cycle efficiency has a corresponding impact on the overall fuel consumption.

$$BSFC = \frac{1}{LHV_{fuel} BTE} \tag{3}$$

An in-line six-cylinder Clean Idle Certified Cummins diesel engine, equipped with a camless variable valve actuation (VVA) system, was utilized to perform the experimental tests. This engine is connected via the driveshaft to a PowerTest AC dynamometer, enabling speed and torque control.

Figure 3:
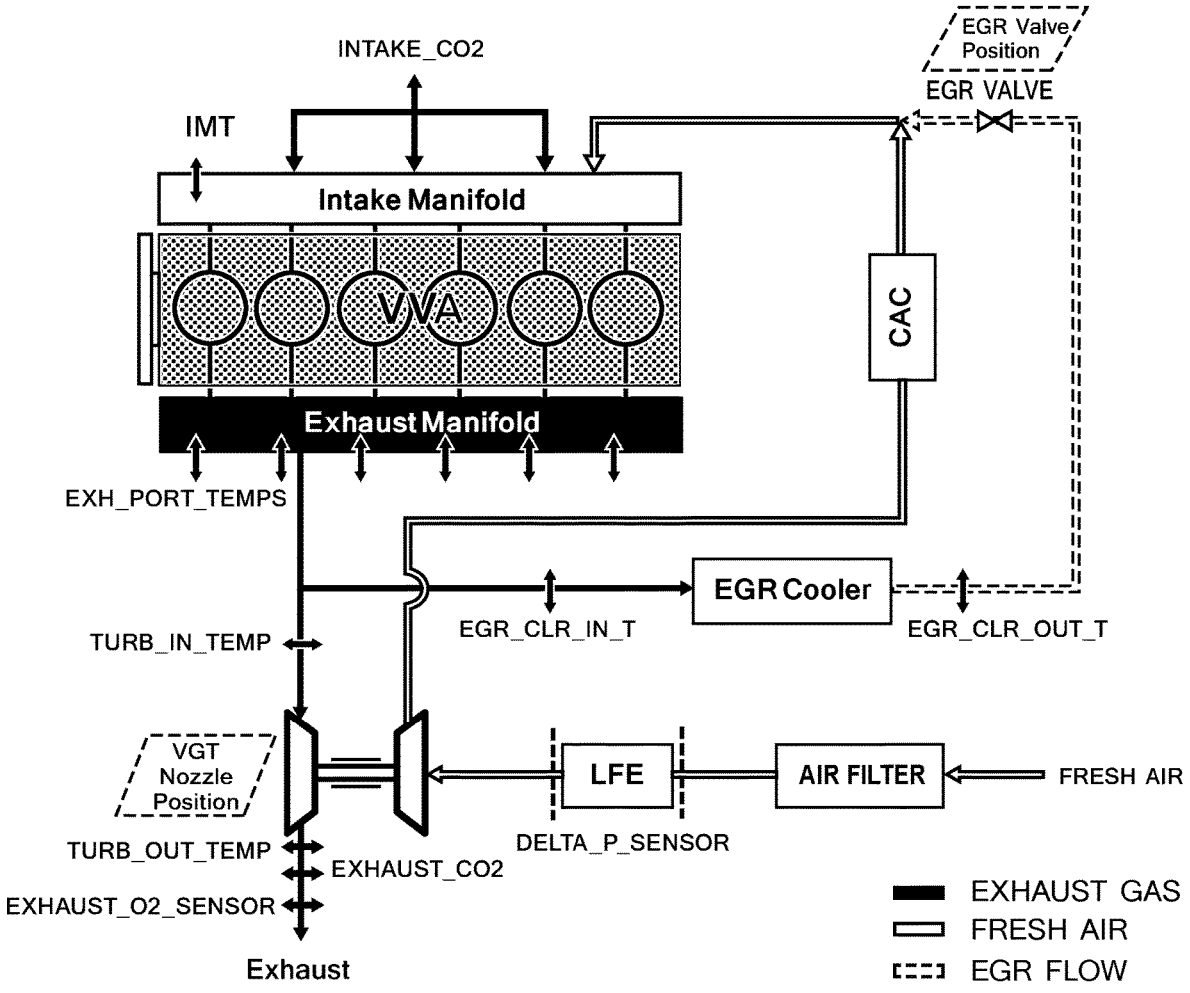
FIG. 3. is a schematic drawing of the air handling system of the engine with the location of sensors having been labeled.

FIG. 3 illustrates the air handling system for this engine, which has a VGT turbocharger and cooled high pressure exhaust gas recirculation (EGR). The fuel system utilizes a high pressure common rail fuel injection arrangement and the cooling system utilizes an air-to-water charge air cooler (CAC).

A laminar flow element is used to measure the flow rate of conditioned fresh air entering the engine. The fuel flow rate is measured gravimetrically via a Cybermetrix Cyrius Fuel Subsystem unit. Cambustion NDIR500 fast $CO/CO_2$ analyzers measure the $CO_2$ concentration in both the intake manifold and the exhaust pipe. NOx measurements at the engine-outlet condition, downstream of the turbocharger, is recorded using a Cambustion CLD500 analyzer in the exhaust pipe. The concentration of soot in the exhaust gas is measured photo-acoustically using an AVL transient analyzer. Real-time temperature and pressure measurements of the coolant, oil, and gas within the intake and exhaust paths are obtained via multiple thermocouples, thermistors, and pressure transducers. A butterfly valve can optionally be used in the exhaust path to replicate the back pressure that results from an in-vehicle exhaust aftertreatment system.

In-cylinder pressure data is obtained using AVL QC34C or Kistler 6067C pressure transducers and relayed through an AVL 621 Indicom module. AVL's 365-series crankshaft position encoder provides crank angle reference.

Interfacing dSpace's data acquisition system with the experimental testbed enables real-time logging and monitoring of the valve profiles, along with additional data parameters. Cylinder-specific, cycle-to-cycle control of engine operating parameters such as the fuel amount, timing, and pressure; VGT nozzle position; and EGR valve position are enabled via a generic serial interface (GSI) connection between the engine control module (ECM) and dSpace system.

Figure 4:
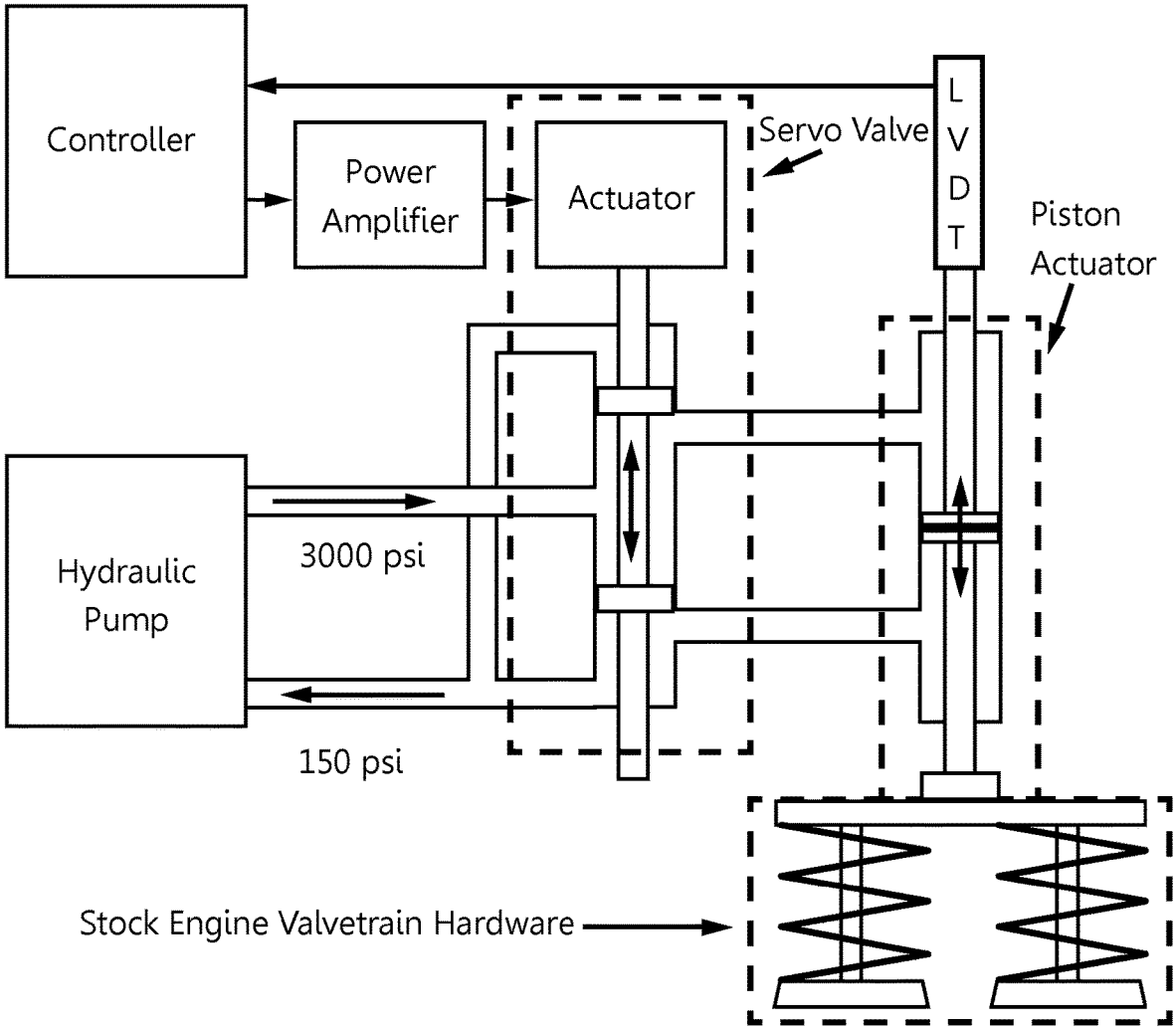
FIG. 4 is a schematic drawing of the variable valve actuation setup illustrating the systems operating principle, which is hydraulically driven via an external pump.

The camless VVA system is fully flexible, allowing for cylinder independent, cycle-to-cycle control of the intake and exhaust valve opening timing, closing timing, lift, and ramp rates. The following VVA enabled strategies will be investigated in this effort: 1) late exhaust valve opening (LEVO), 2) early exhaust valve opening (EEVO), and 3) negative valve overlap (NVO). FIG. 4 is a schematic of the variable external pump, and illustrates the systems operating principle, which is hydraulically driven via an external pump. Linear variable differential transformers (LVDT) provide position feedback and real-time control of individual valve pairs, two per cylinder.

Experimental Results at High Idle Speeds

Steady state tests were conducted at 800 RPM 1.3 bar BMEP (curb idle), 1000 RPM 1.3 bar BMEP, and 1200 RPM 1.3 bar BMEP. The following summarizes the strategies investigated in this effort at each idle speed:

1. Thermal Management (TM) Cal. w/o VVA at 800 RPM (Baseline),
2. TM Cal. w/o VVA at 1000 RPM,
3. TM Cal. w/o VVA at 1200 RPM,
4. EEVO+iEGR at 800 RPM,
5. EEVO at 1000 RPM,
6. EEVO at 1200 RPM,
7. LEVO at 800 RPM,
8. LEVO at 1000 RPM,
9. LEVO at 1200 RPM (v1),
10. LEVO at 1200 RPM (v2).

Table 1, shown in FIG. 16, quantifies the EVO timing for the tested strategies and compares "warm-up" thermal management performance, fuel efficiency, and emissions to the curb idle baseline (TM Cal. w/o VVA at 800 RPM). All strategies exhibit the same or improved emissions and "warm-up" performance, generally at the expense of increased fueling relative to the baseline.

Summary table of results at 1.3 bar BMEP and the tested idle speeds 800 RPM, 1000 RPM, and 1200 RPM. Each strategy is compared to the baseline (TM Cal. w/o WA at 800 RPM) based on aftertreatment "warm-up" performance, fuel consumption, and emissions. The check mark signifies an improvement in performance, while the cross mark signifies a decline in performance, compared to the baseline.

Figure 5:
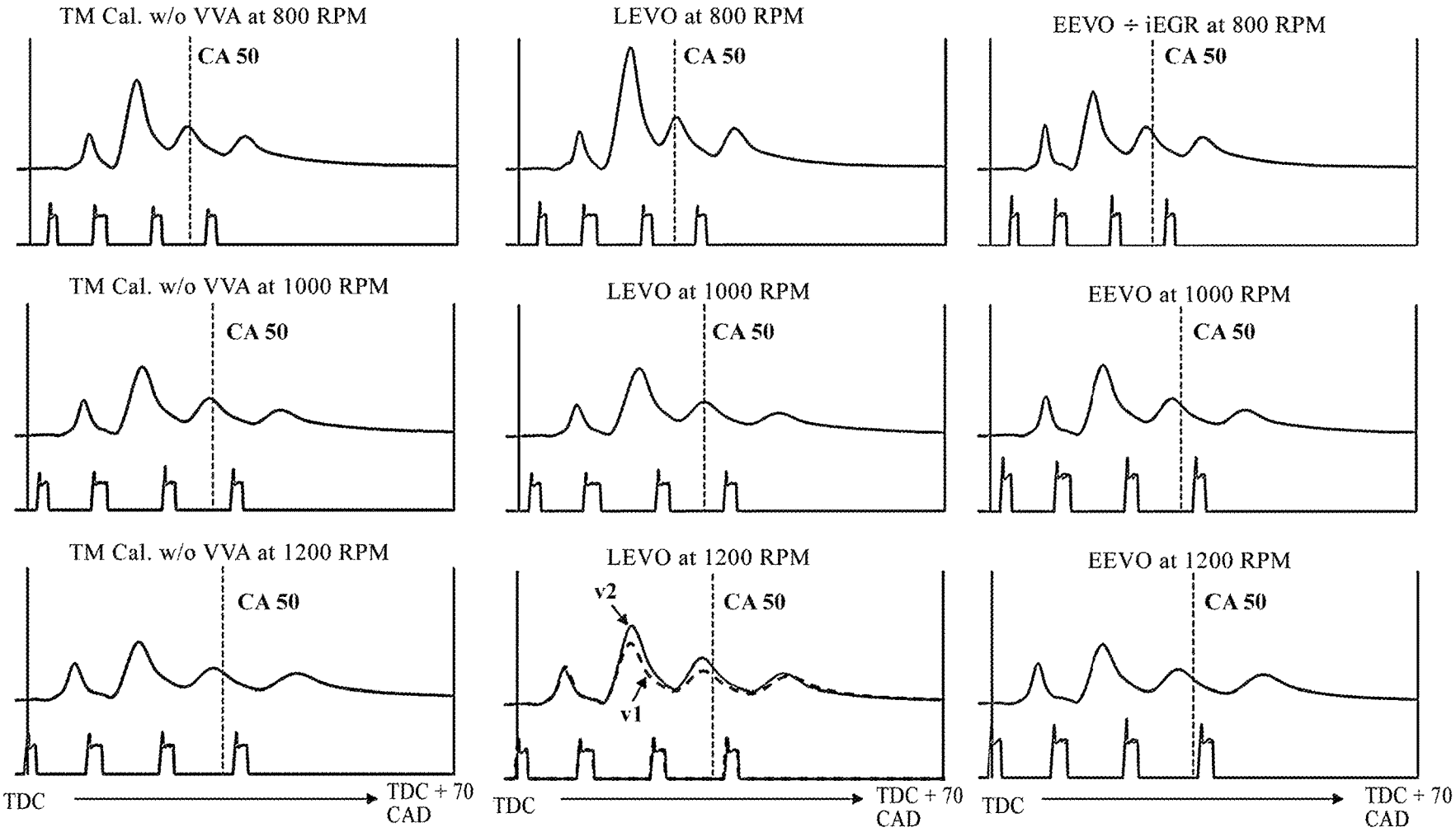
FIG. 5 shows graphs providing injection timings, corresponding heat release rates, and crank angle reference at which 50% of the total energy is released (CA 50) for each strategy illustrated in FIG. 5.

The baseline utilizes four late injections and a maximally closed VGT (e.g. 100% closed) for thermal management performance. Similarly, the thermal calibrations without WA at 1000 RPM and 1200 RPM utilize four late injections and a mostly closed VGT to improve the aftertreatment thermal management performance. The injection timings, corresponding heat release rates, and crank angle reference at which 50% of the total energy is released (CA 50) for each strategy are illustrated in FIG. 5.

Figure 6A:
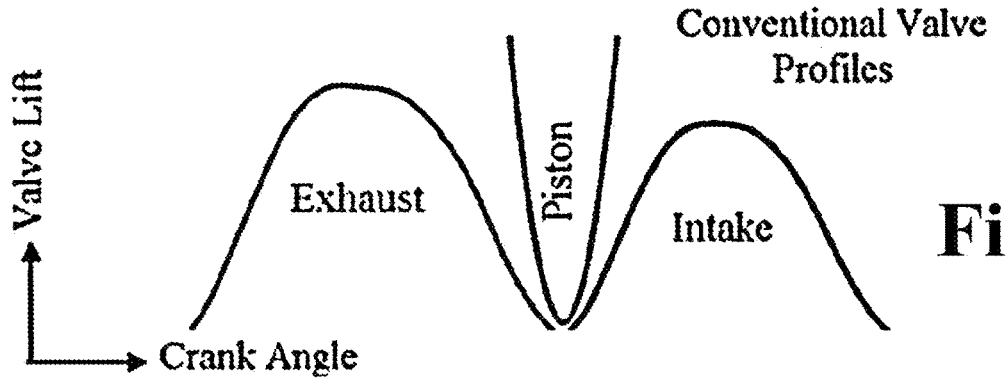
FIGS. 6 (*a*) to (*h*) comprises graphs illustrating the different valve profiles examined. The thermal calibration without WA at 800 RPM, 1000 RPM, and 1200 RPM correspond to the conventional valve profiles in FIG. 6(*a*). The EEVO strategies at the various idle speeds are represented by the exhaust profiles shown in FIGS. 6(*b*), 6(*c*), and 6(*d*). The LEVO strategies at the various idle speeds correspond to the exhaust profiles shown in FIGS. 6(*e*), 6(*f*), 6(*g*), and 6(*h*).
Figure 6B:
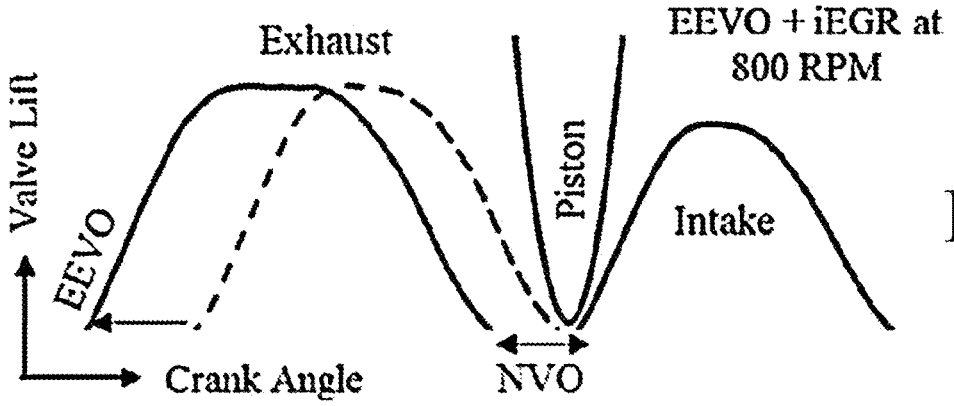
Figure 6C:
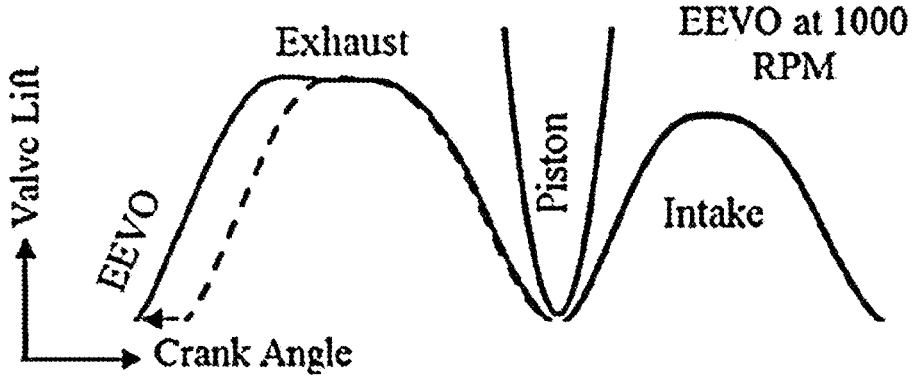
Figure 6D:
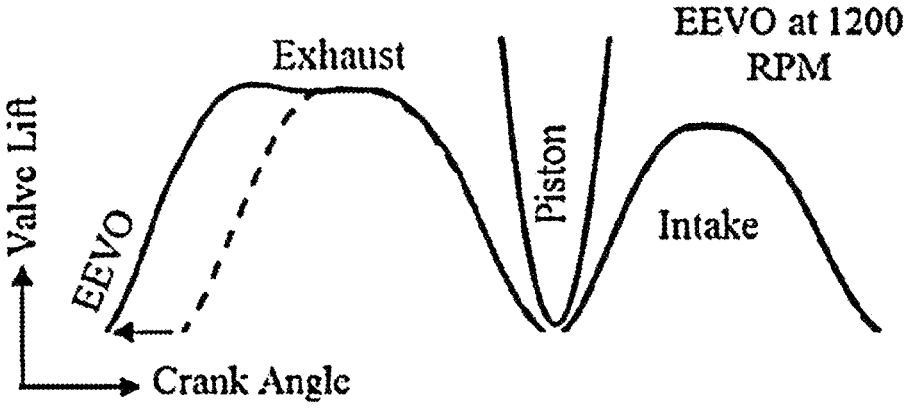
Figure 6E:
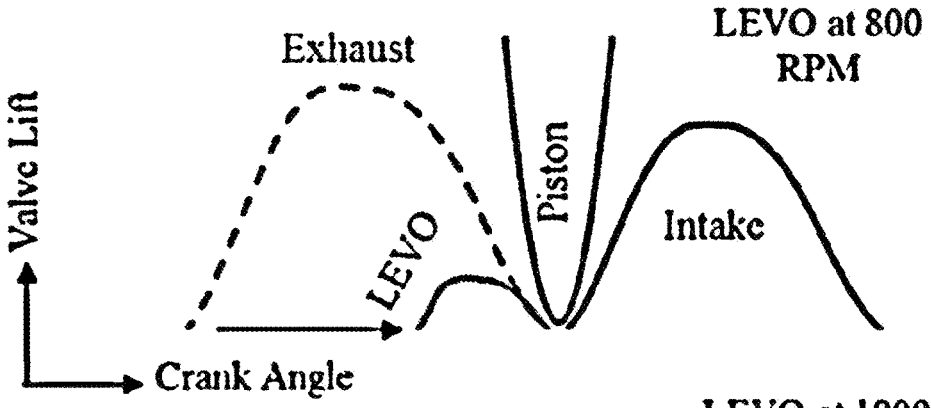
Figure 6F:
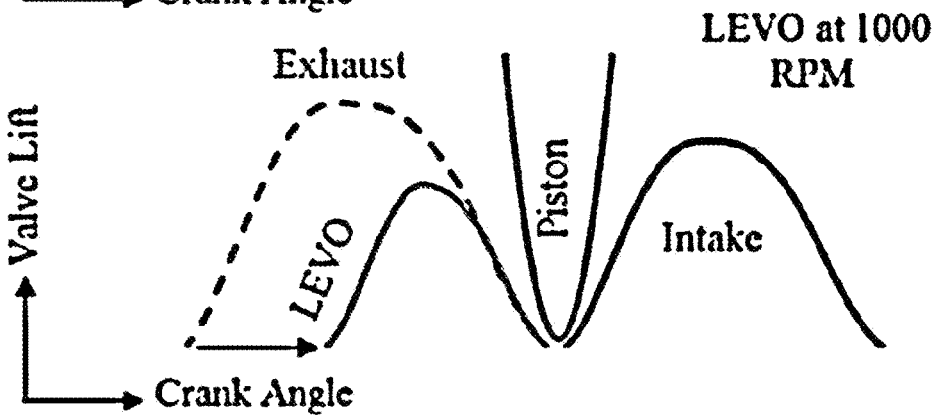
Figure 6G:
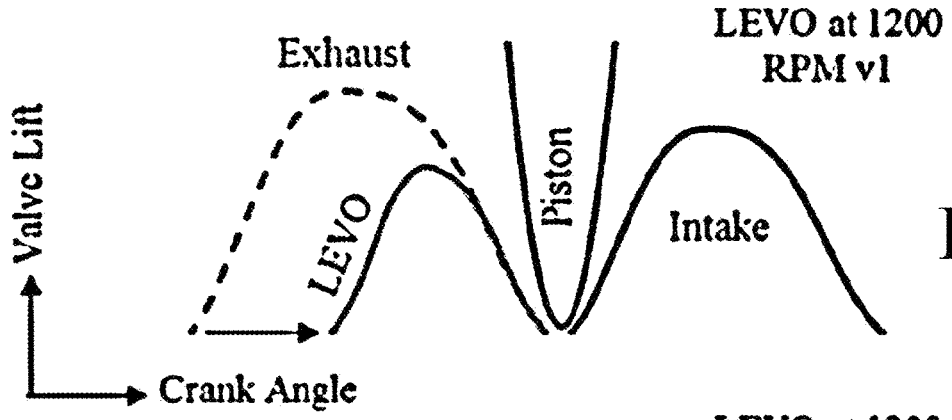
Figure 6H:
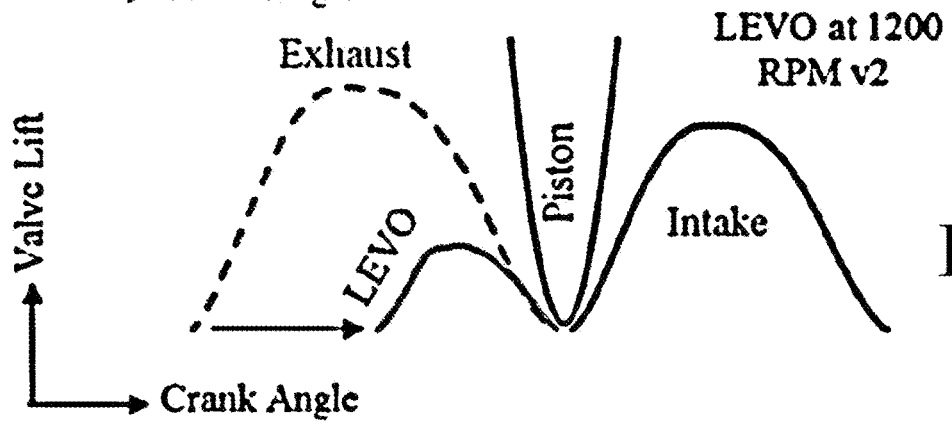

FIGS. (a) to (h) illustrates the different valve profiles. The thermal calibration without WA at 800 RPM, 1000 RPM, and 1200 RPM correspond to the conventional valve profiles in FIG. 6*a*. The EEVO strategies at the various idle speeds are represented by the exhaust profiles shown in FIGS. 6*b*, 6*c*, and 6*d*. The LEVO strategies at the various idle speeds correspond to the exhaust profiles shown in FIGS. 6*e*, 6*f*, 6*g*, and 6*h*. FIGS. (a) to (h) Valve profiles for the tested strategies are shown, where (a) corresponds to conventional operation, (b)-(d) corresponds to EEVO operation, and (e)-(h) corresponds to LEVO operation.

Impact on the Gas Exchange

FIG. 7 illustrates the gas exchange behavior for each of the low-load strategies. As shown, elevating the idle speed enables a significant increase in charge flow and air flow through the engine. Specifically, compared to an idle speed of 800 RPM, nearly a 30% increase in air flow was realized when using an idle speed of 1000 RPM, and a 50% increase when using 1200 RPM. High idle speeds alone are capable of elevating air flow and increasing fuel consumption to achieve an air-to-fuel (AFR) similar to the conventional idle strategy at 800 RPM, per FIG. 7. FIGS. 7.(*a*) and (*b*) correspond to the charge flow and air flow through the engine, which are each normalized to TM Cal. w/o WA at 800 RPM. (*c*), (*d*), and (*e*) correspond to the EGR fraction, air-to-fuel ratio, and the turbine outlet temperature for the tested strategies.

Figures 7A, 7B, 7C, 7D, 7E:
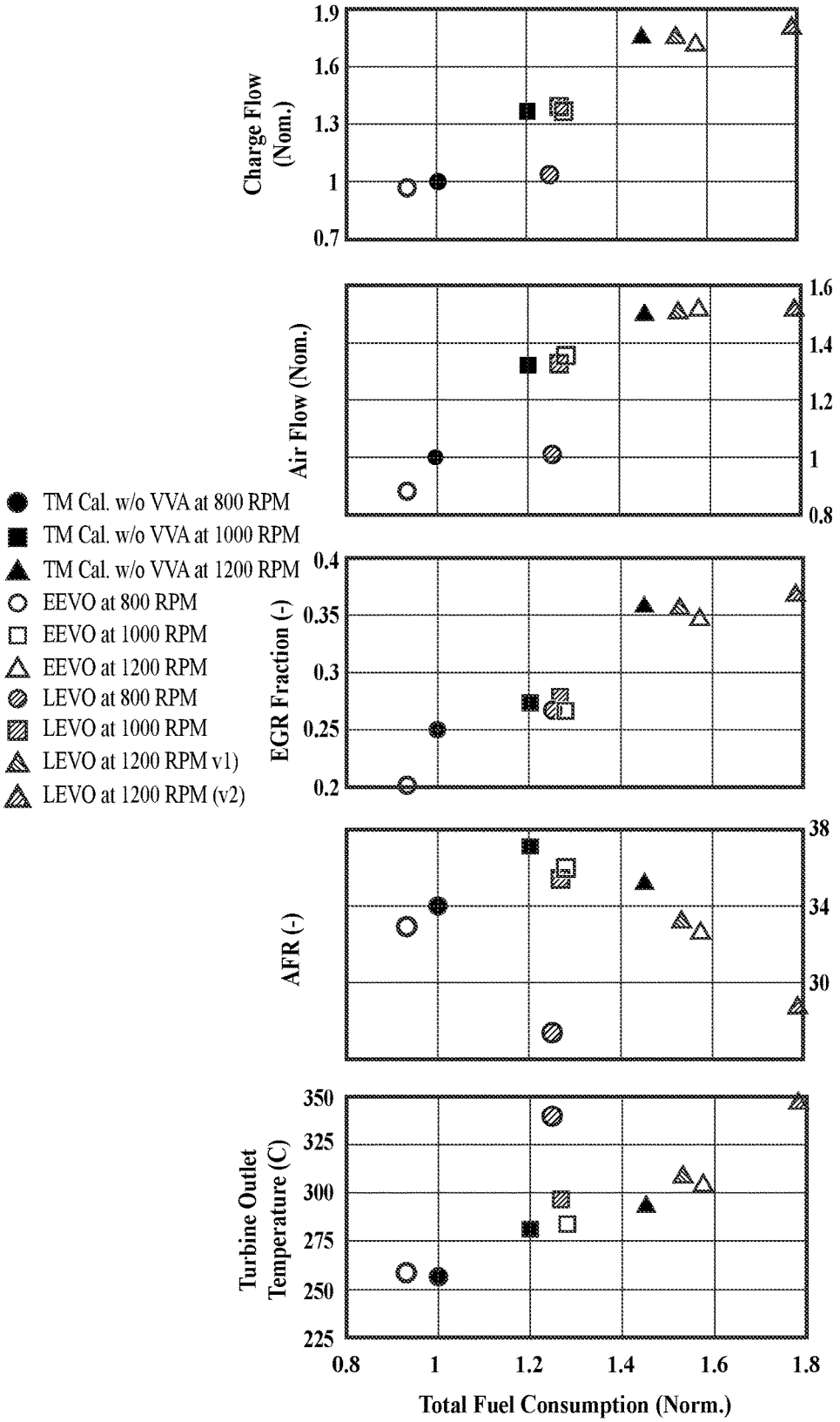
FIGS. 7 (*a*) and (*b*) are graphs corresponding to the charge flow and air flow through the engine, which are each normalized to TM Cal. w/o VVA at 800 RPM.

FIG. 7 also shows that implementing early or late EVO allowed air flow and charge flow rates comparable to the thermal management calibration at each of the tested idle speeds. FIG. 7*d* illustrates the ability for EVO modulation to reduce AFR by forcing the engine to work harder and increase fueling. However, EEVO at 800 RPM resulted in an elevated AFR without realizing a significant change to the air flow rate due to an open VGT position, which was required to decrease fuel consumption and constrain PM.

Generally, reducing AFR enables higher engine-out exhaust temperatures. FIG. 7*e* illustrates this concept at each of the tested idle speeds. Compared to the thermal calibrations without WA, EVO modulation enables higher TOTs via lower AFRs as a result of increased fueling at each idle speed. Specifically, LEVO enabled significant improvements to TOT due to a significant increase in fuel consumption.

Figure 8:
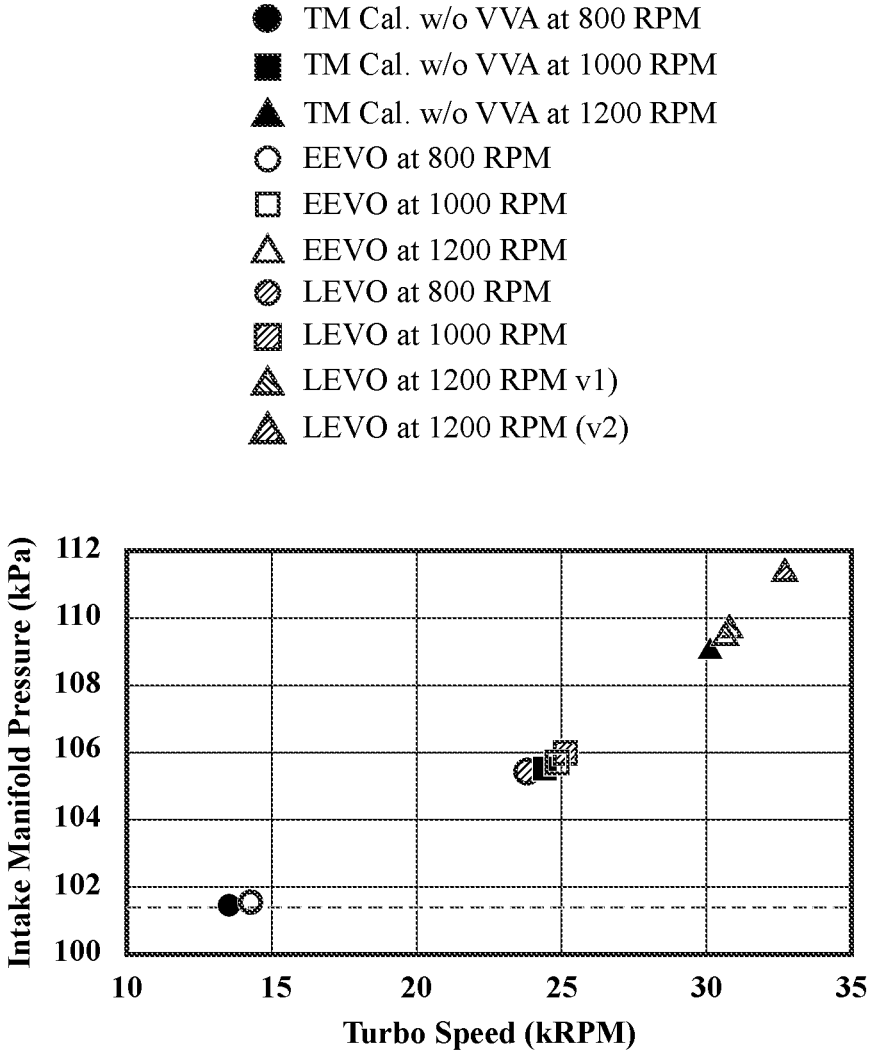
FIG. 8 is a graph of the relationship between turbo speed and intake manifold pressure for the tested strategies.

FIG. 8 illustrates the relationship between intake manifold pressure and turbo speed. As shown, higher idle speeds result in higher intake manifold pressures due to increased mass flow through the cylinders and turbine. This results in ~5 kPa of boost at 1000 RPM and ~8 kPa of boost at 1200 RPM, while the conventional idle speed (800 RPM) realizes no boost.

Early and late EVO typically enable higher boost pressures as a result of increasing the turbine speed. EEVO utilizes an early blow down of the in-cylinder exhaust gas to increase the enthalpy at the inlet of the turbine, leading to a higher turbine speed. However, early blow-down of exhaust gas also reduces the time available for PM oxidization, which limits the amount of EEVO, the enthalpy at the inlet of the turbine, and the ability to increase the turbine speed, per FIG. 8. Alternatively, LEVO increases the kinetic energy by re-compressing the exhaust gases before they are expelled through a throttled exhaust valve, thereby increasing the turbine speed. Specifically, squeezing the exhaust gases across a throttled exhaust valve effectively increases the velocity of the gases passing through the turbine, resulting in elevated boost pressures. FIG. 8 shows how LEVO was more effective at increasing the turbine speed and intake manifold pressure at all three idle speeds. As a result, despite requiring higher EGR fractions, LEVO at each idle speed was capable of achieving air flow rates equal to, or higher than, the thermal calibration without WA, per FIG. 7.

Impact on Efficiency

In-cylinder pressure plots for each strategy are shown via log-p log-v diagrams in FIG. 9. FIG. 9.(*a*) Log P-Log V diagram for the thermal management calibration without WA at 800 RPM, 1000 RPM, and 1200 RPM. (*b*) Log P-Log V diagram for the strategies tested at 800 RPM. (*c*) Log P-Log V diagram for the strategies tested at 1000 RPM. (*d*) Log P-Log V diagram for the strategies tested at 1200 RPM.

The amount of pumping work (i.e. the size of the pumping loop) generally correlates to OCE, as lower pumping work results in higher OCE. Higher back-pressure on the engine increases the pumping work by forcing the engine to work harder to pump charge gas. Similarly, increasing the amount of charge gas transmitted from the intake to exhaust manifold generally requires the engine to work harder to pump gas. The TM Cal. w/o WA at 800 RPM utilizes a maximally closed VGT position to create an adverse pressure gradient, resulting in elevated pumping work and fuel consumption. The thermal calibrations without WA at elevated idle speeds implement a mostly closed VGT position, which reduces the pumping work relative to the TM Cal. w/o VVA at 800 RPM despite having higher charge flows, per FIG. 7.

FIG. 10 illustrates the cycle efficiencies for the tested strategies. As shown, OCE for the thermal calibrations without WA increases with idle speed. This is primarily due to a reduction in pumping work as the VGT is less closed at higher idle speeds, therefore creating less back pressure on the engine and a smaller pumping loop, per FIG. 9*a*.

Figures 10A, 10B, 10C:
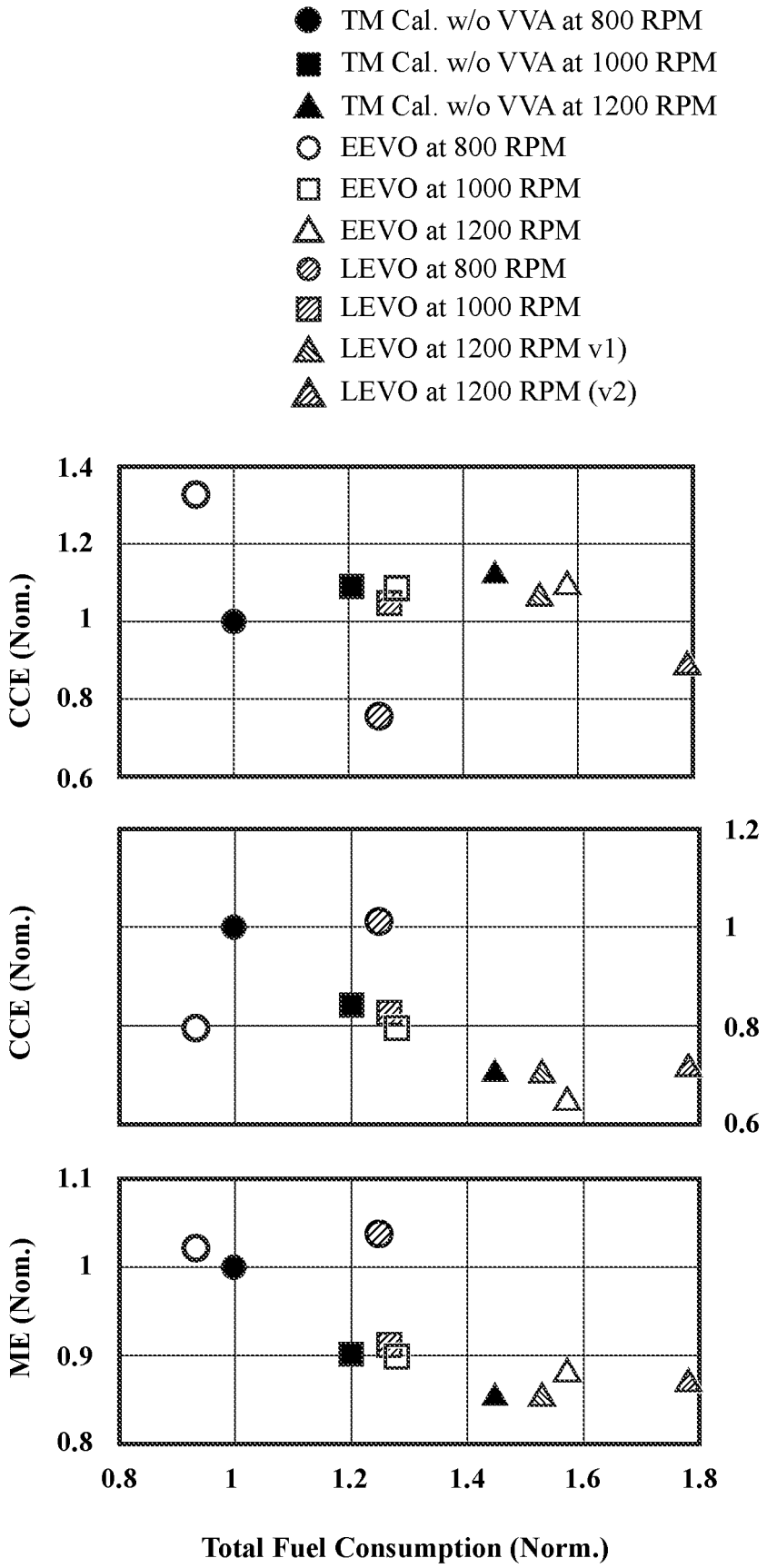
FIG. 10 includes graphs showing open, closed, and mechanical efficiencies for the tested strategies.
Figure 11:
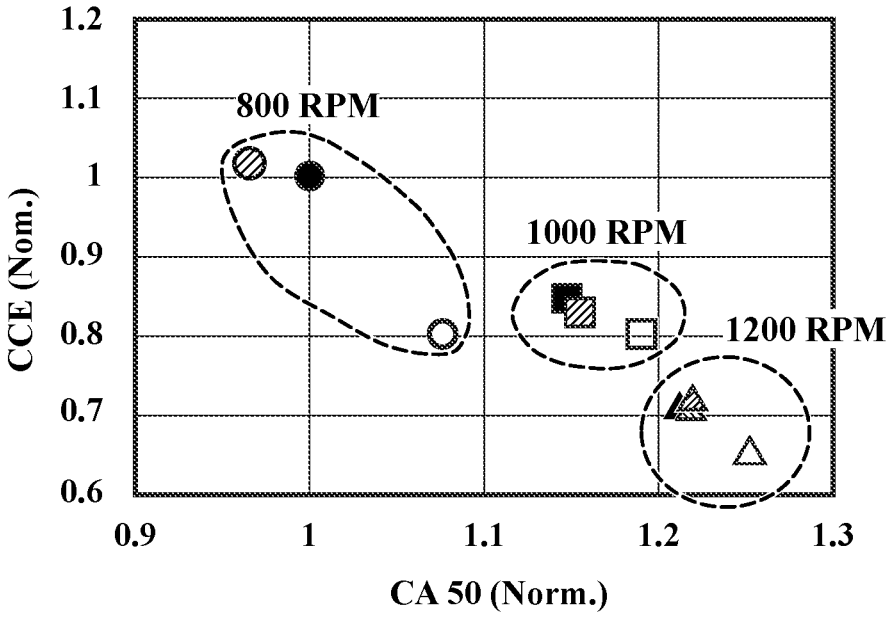
FIG. 11 is a graph of the relationship between closed cycle efficiency and CA 50 for the tested strategies.

The elevated idle speed strategies without VVA resulted in a 15% reduction in CCE at 1000 RPM and a 30% reduction in CCE at 1200 RPM, relative to the TM Cal. w/o VVA at 800 RPM, per FIG. 10*b*. These reductions in CCE primarily resulted from a delay in the heat release, as illustrated by the CA 50 timings in FIG. 5. FIG. 11 shows the relationship between the CA 50 timing and CCE, where earlier CA 50 timings generally result in higher CCE. As shown, high idle speeds significantly delayed the CA 50 timing relative to conventional idle, resulting in a reduction in CCE and therefore fuel efficiency.

Figure 9A:
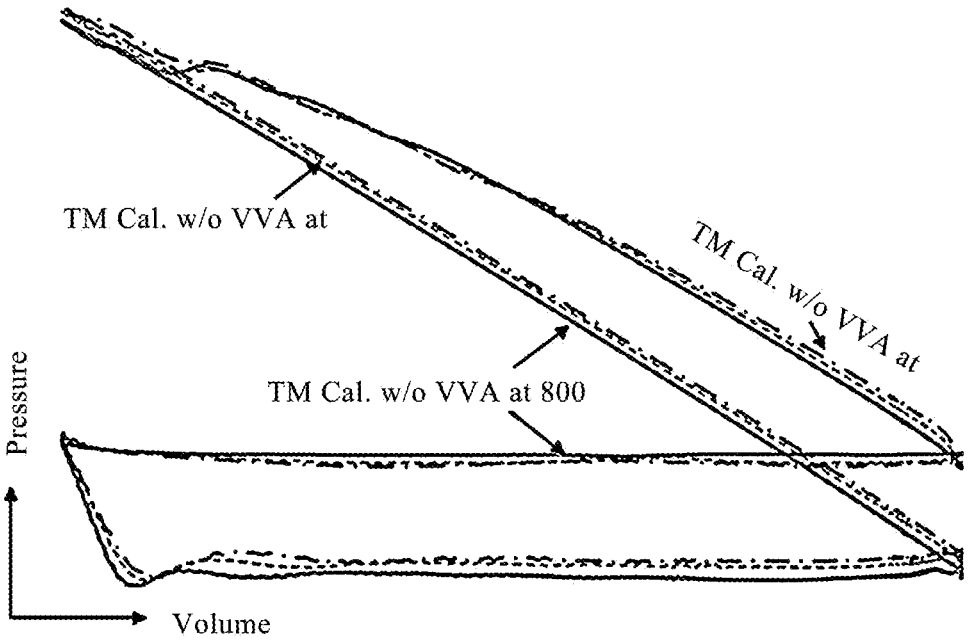
FIG. 9 (*a*) is a Log P-Log V diagram for the thermal management calibration without WA at 800 RPM, 1000 RPM, and 1200 RPM.
Figure 9B:
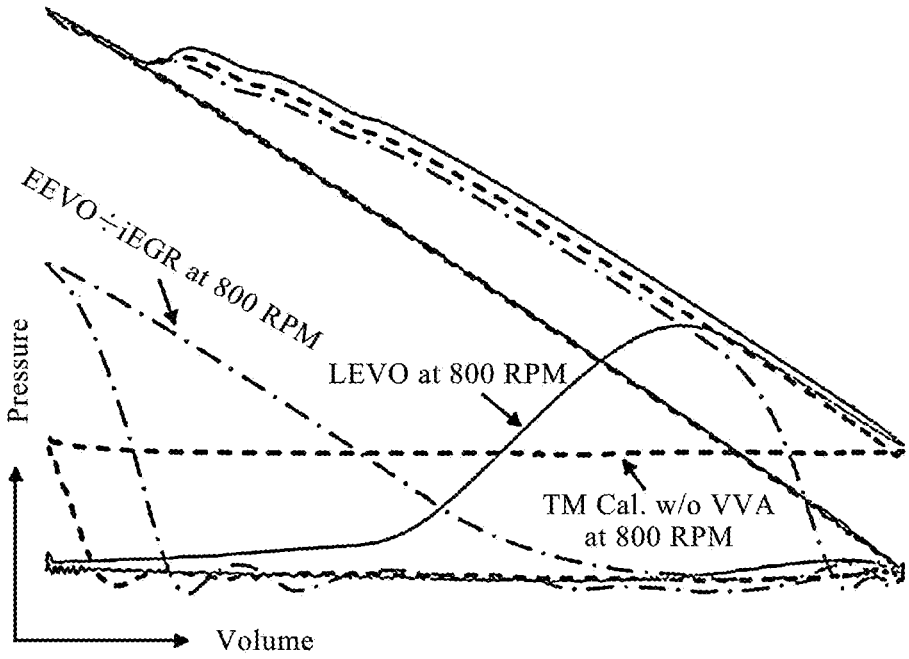
Figure 9C:
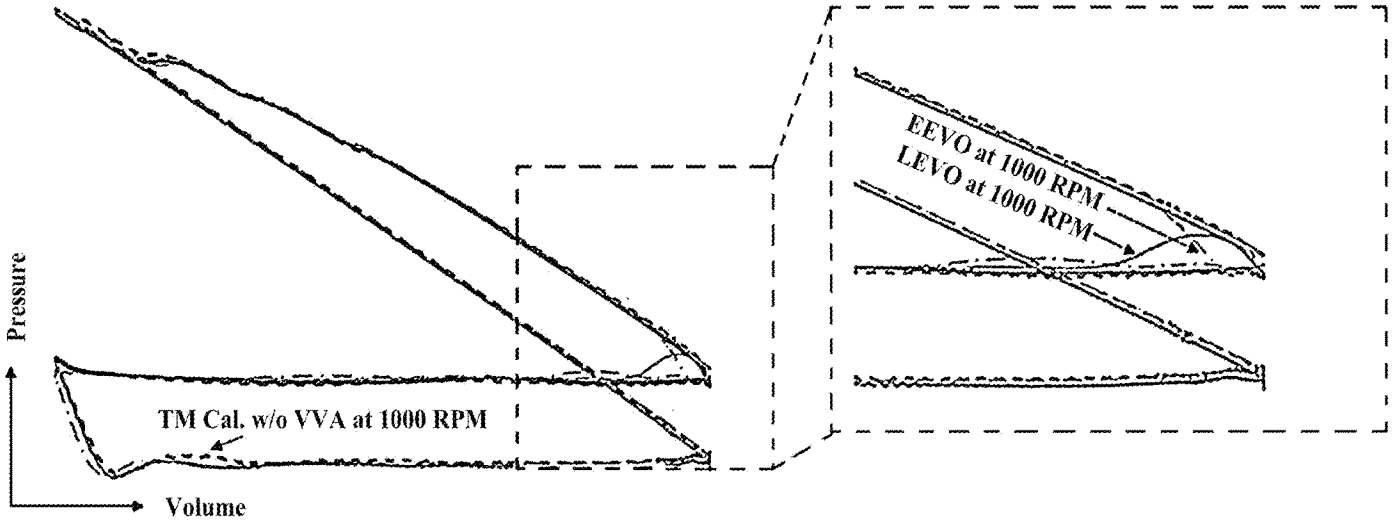
Figure 9D:
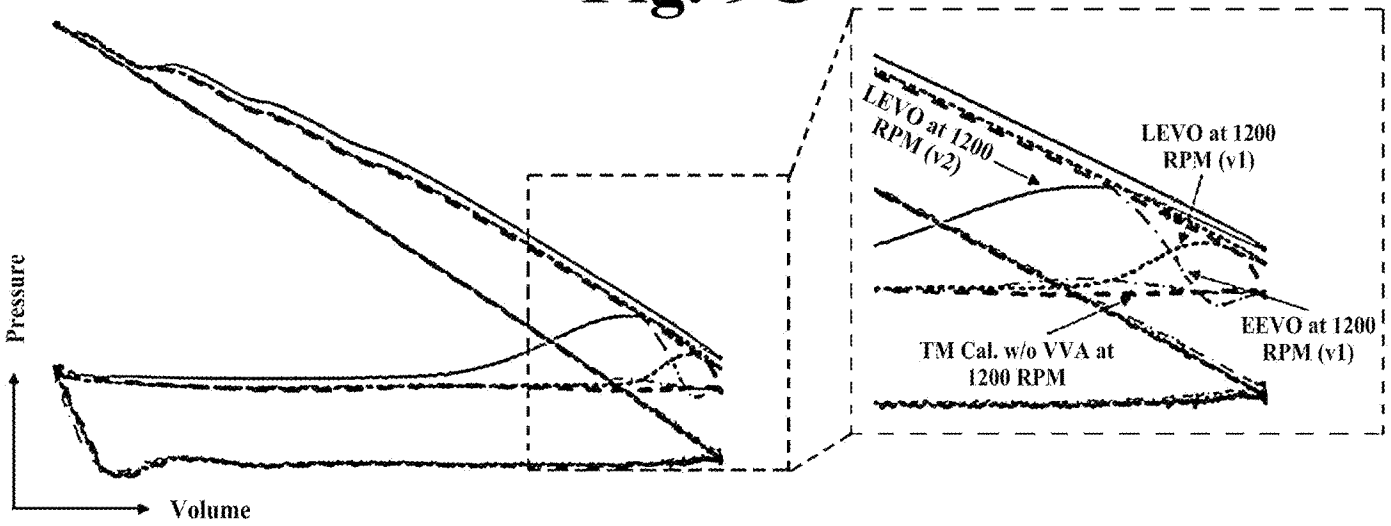

EVO modulation impacted both CCE and OCE. Specifically, LEVO forced the engine to work harder to pump gases from the cylinder to the exhaust, thereby penalizing the OCE without significantly impacting CCE or ME, per FIG. 10. This increase in pumping work (i.e. larger pumping loop) is illustrated in FIGS. 9*b*, 9*c*, and 9*d*, where reducing the duration and lift of the exhaust profile elevates the in-cylinder pressures by re-compressing the in-cylinder gases before opening the valve, while also forcing the engine to work harder to expel the gas through a small opening. As a result, LEVO required additional fuel to overcome the extra pumping work it created at each idle speed.

FIG. 10*b* shows EEVO's ability to decrease CCE by forcing an early blow-down of the exhaust gases during the expansion stroke. Specifically, EEVO required additional fuel to account for the reduction in the effective expansion ratio (EER) without significantly impacting OCE or ME at high idle speeds, per FIGS. 10*a* and 10*c*. At 800 RPM, iEGR in the form of negative valve overlap (NVO) was utilized with EEVO to constrain NOx emissions by trapping exhaust gases in the cylinder. Additionally, the VGT position was opened significantly to reduce the size of the pumping loop, enabling less fuel to be consumed and PM to be constrained.

Utilizing iEGR combined with EEVO yielded comparable fuel consumption to TM Cal. w/o WA at 800 RPM by improving OCE and penalizing CCE. Specifically, trapping exhaust gas resulted in a re-compression of in-cylinder gases near TDC, while an early-blow down of exhaust gas resulted in a reduction in EER, per FIG. 9*b*.

Impact on Aftertreatment Thermal Management

Figure 12:
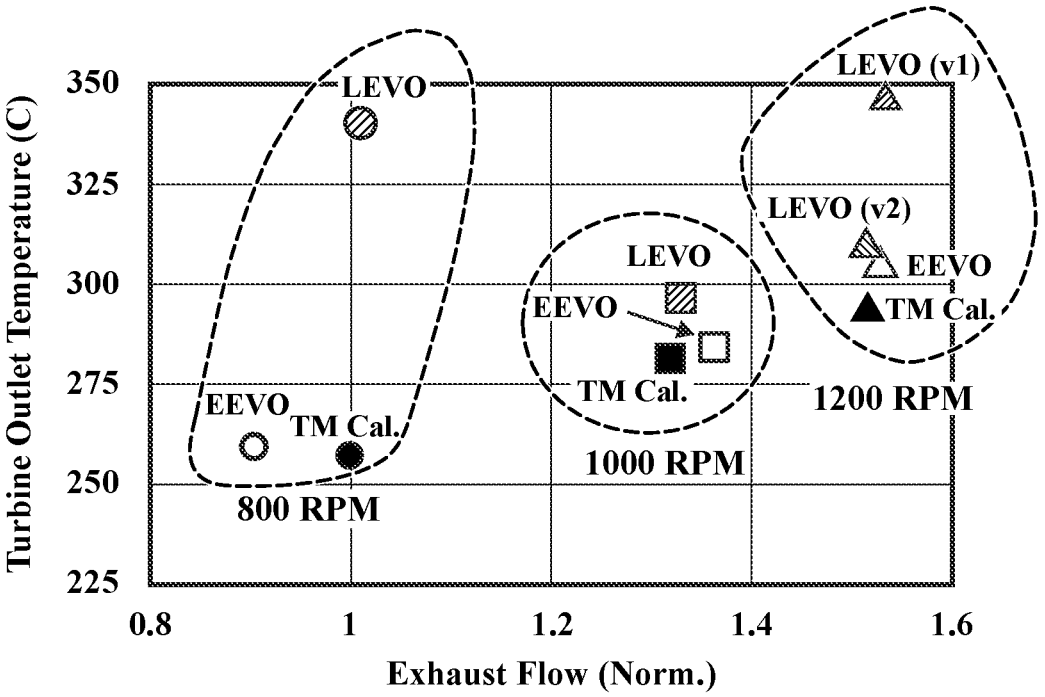
FIG. 12 is a graph showing exhaust flow and turbine outlet temperature for the tested strategies, which are used to obtain the exhaust gas-to-catalyst heat transfer rate FIG. 13 (*a*) is a heat transfer rate diagram for the thermal management calibration without WA at 800 RPM, 1000 RPM, and 1200 RPM.

The steady-state exhaust flow and turbine outlet temperature (TOT) for each strategy is shown in FIG. 12. The elevated idle speed (1000 and 1200 RPM) conditions, without VVA, realized a 31% and 51% increase in exhaust flow, respectively, and a 25° C. and 30° C. increase in TOT, respectively, compared to the TM Cal. w/o VVA at 800 RPM. FIG. 12 illustrates how implementing EVO modulation generally resulted in additional TOT benefits at each of the idle speeds. LEVO at 800 RPM enabled an 85° C. increase in TOT, while maintaining the same exhaust flow rate. However, EEVO+iEGR at 800 RPM realized a ~9% reduction in exhaust flow, while maintaining similar TOT.

LEVO at 1000 RPM enabled an additional 15° C. above the TM Cal. w/o WA at 1000 RPM, while EEVO enabled a 3% increase in exhaust flow. At 1200 RPM, LEVO and EEVO realized an additional 53° C. and 5° C. above the TM Cal. w/o VVA at 1200 RPM, respectively. As shown in FIG. 12, high idle speeds have the largest impact on engine-out flow rates, whereas EVO modulation enables additional exhaust heat without penalizing the improved engine-out mass flow.

Both TOT and exhaust flow have a direct impact on the heat transfer rate from the exhaust gas to the aftertreatment system via Equation 1. This equation is a function of experimental data that was obtained for each of the tested strategies. The temperature at which $\dot{q}=0$ represents the TOT for the given strategy. The slope of Equation 1 correlates to exhaust flow. Higher exhaust flow rates increase the positive heat transfer rate when TOT is larger than $T_{catalyst}$. Conversely, high exhaust flow rates for TOT values smaller than Tcatalyst lead to faster cooling of the aftertreatment system.

FIG. 13 represents an approximation of the relative heat transfer rate, per Equation 1, from the engine-out gas to the aftertreatment system components. FIG. 13*a* illustrates the difference between exhaust heat rate for thermal management idle operation at 800 RPM, 1000 RPM, and 1200 RPM without WA. As shown, the elevated idle speeds enable an increase in exhaust flow (i.e. steeper slope), an increase in TOT, and an overall improvement to the thermal management warm-up performance.

Figure 13A:
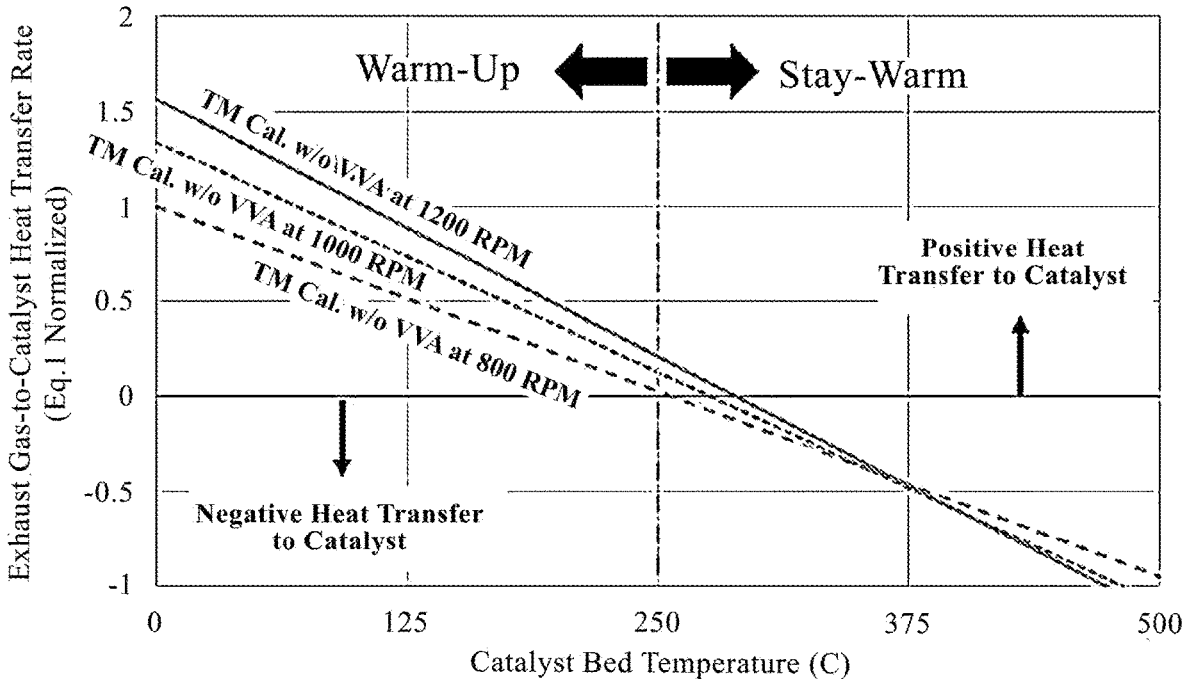
FIG. 13 (*b*) is a heat transfer rate diagram for the strategies tested at 800 RPM and compared against the baseline.
Figure 13B:
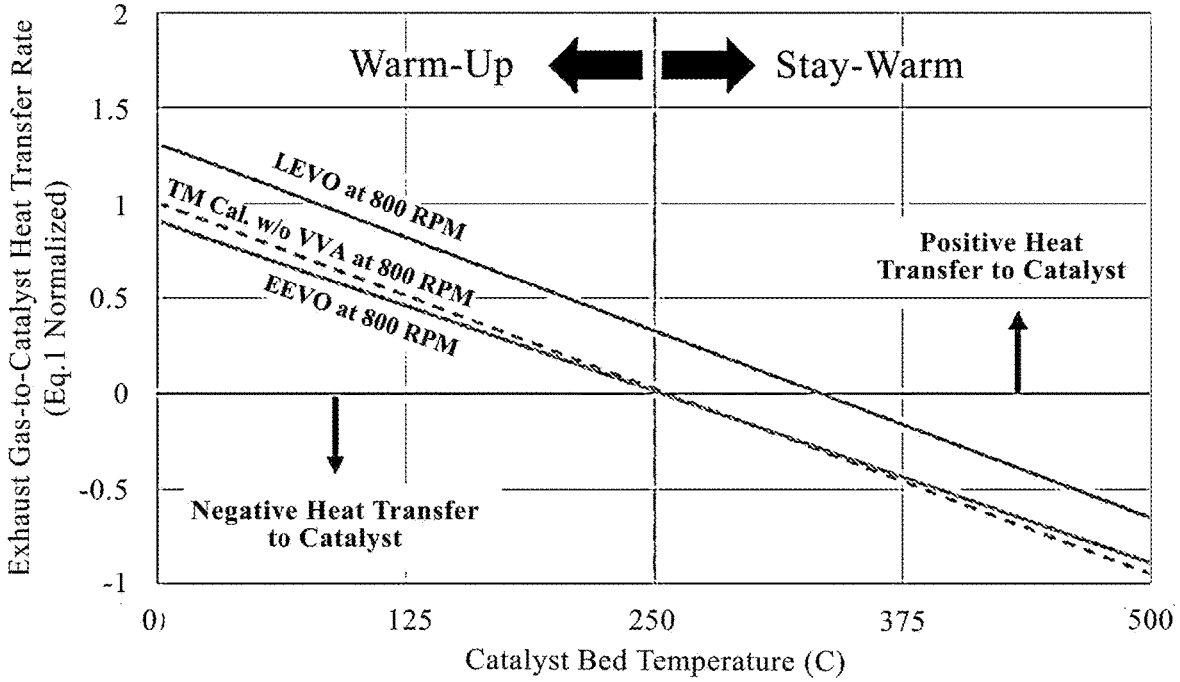

FIG. 13*b* illustrates how EVO modulation at conventional idle enables an improvement in thermal management performance relative to TM Cal. w/o VVA at 800 RPM. Specifically, EEVO at 800 RPM enabled comparable exhaust flow and TOT, and therefore warm-up performance, while realizing a 6.5% improvement in fuel efficiency. LEVO at 800 RPM enable a comparable exhaust flow rate, while increasing fuel consumption to achieve higher TOTs, resulting in an improved warm-up performance.

Figure 13C:
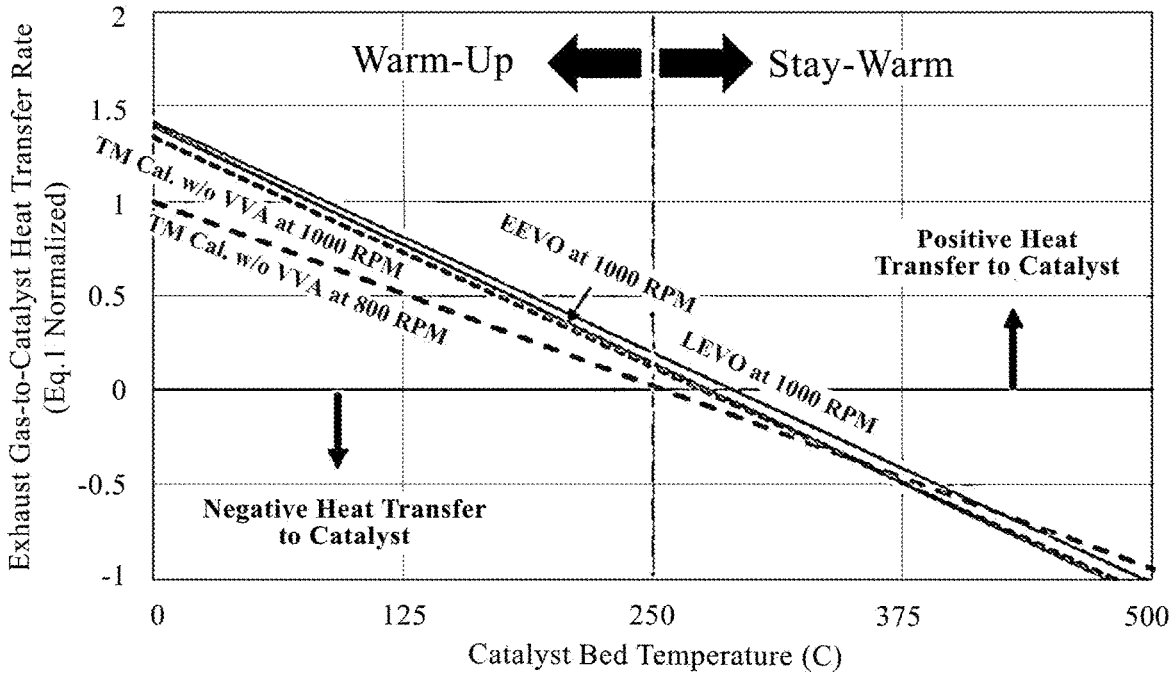
Figure 13D:
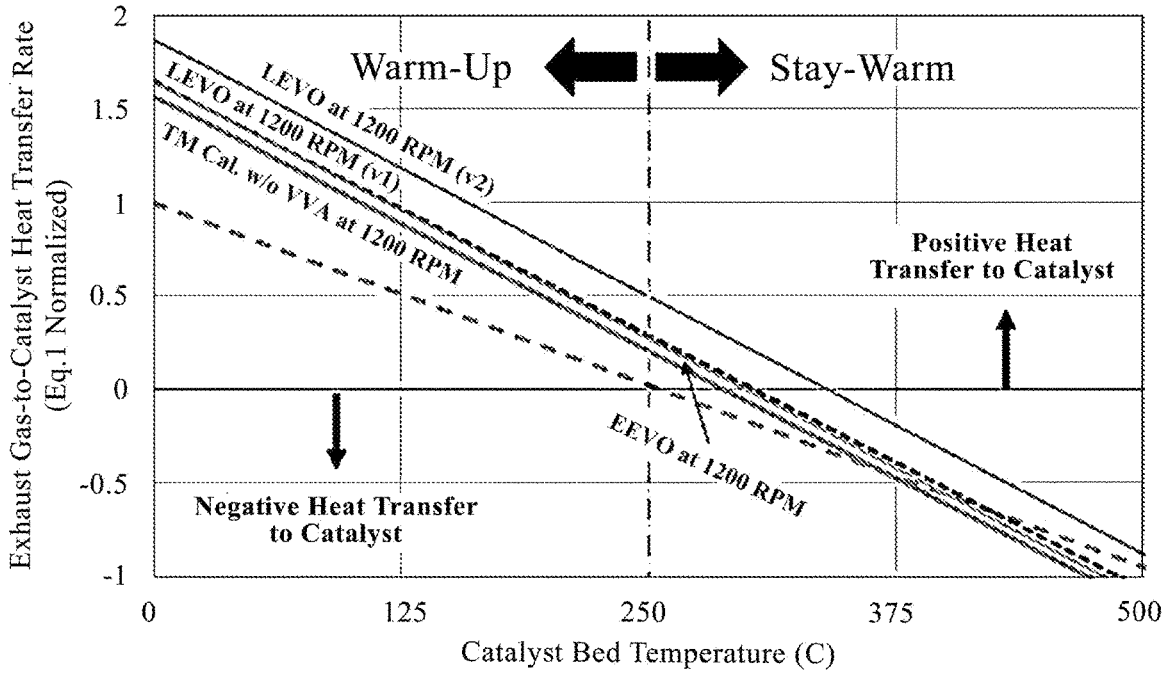

FIGS. 13*c* and 13*d* represent how EVO modulation enables an improvement in thermal management performance relative to the TM Cal. w/o VVA at 800 RPM at elevated idle speeds. As shown, EEVO was not as effective as LEVO at achieving improved thermal management performance. EEVO's early blow-down of exhaust gas reduced the time available for PM oxidization, which effectively limited the ability to increase fuel (i.e. lower AFR) and elevate TOT. In general, EVO modulation, specifically LEVO, utilized an increase in fuel consumption to achieve elevated TOTs and exhaust flow rates, both of which significantly improved the warm-up performance, per FIG. 13.

Increasing the idle speed to 1200 RPM realized the largest improvement to exhaust flow. As a result, the thermal calibration at 1200 RPM, without WA, enabled a significant improvement to the exhaust gas-to-catalyst heat transfer rate, averaging approximately 1.5× higher than the baseline TM Cal. w/o VVA at 800 RPM for catalyst temperatures below 250° C., per FIG. 13*d*. Conversely, with valvetrain flexibility, LEVO at 1200 RPM (v2) enabled the largest improvement in the exhaust gas-to-catalyst heat transfer rate. Specifically, LEVO at this condition realized a heat transfer rate ~2× higher than the baseline TM Cal. w/o VVA at 800 RPM for catalyst temperatures below 250° C., per FIG. 13*d*.

Impact on Emissions

Figure 14A:
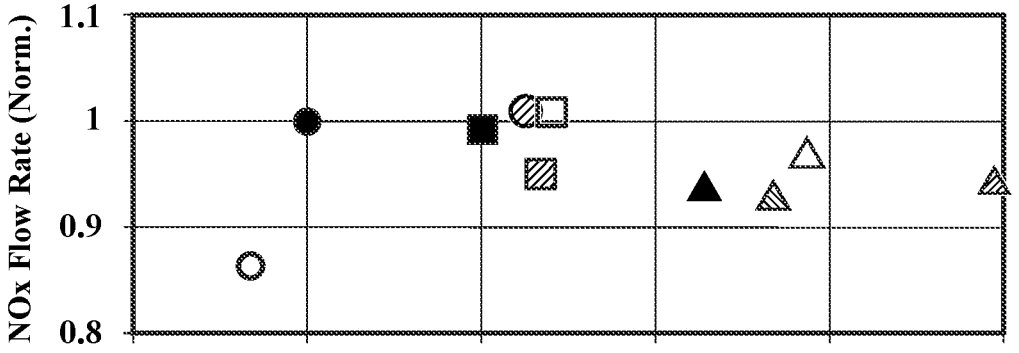
FIG. 14 includes graphs of NOx and PM normalized on a flow rate basis for the tested strategies.
Figure 14B:
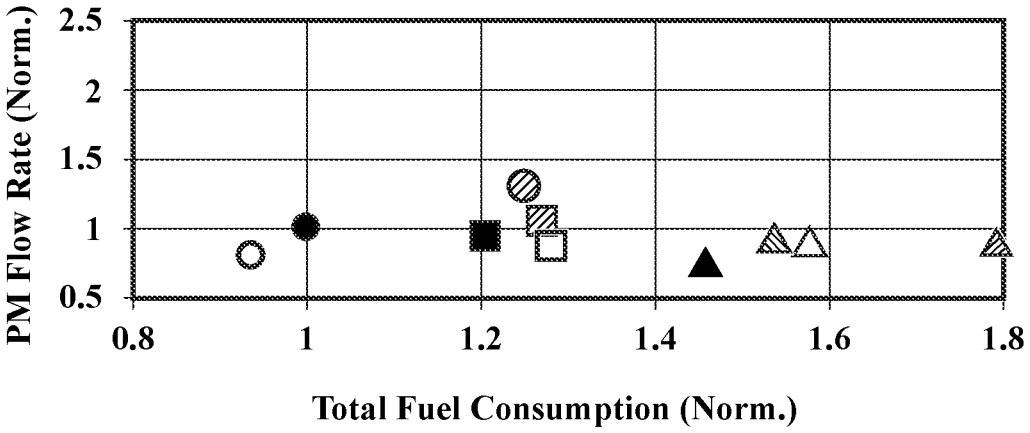

FIG. 14 illustrates the emissions for the tested strategies normalized to the TM Cal. w/o WA at 800 RPM for each operating condition. These emissions were constrained on a flow rate basis (i.e. mass/time), such that the high idle speed strategies do not produce more overall NOx or PM than the stock curb idle operation at 800 RPM and 1.3 bar BMEP. As shown, all strategies had the same, or better, NOx than the stock operation, per FIG. 14. The LEVO strategy at 800 RPM had slightly higher PM output due to a low air-to-fuel ratio, while the remaining strategies exhibited the same as, or better, PM than the stock operation.

In summary, elevating the idle speed realized significant improvements in engine-out temperatures (i.e. TOT) and mass flow rates without utilizing a flexible valvetrain. These improvements resulted in faster aftertreatment "warm-up" rates without compromising engine-out NOx or PM. Additional improvements to the aftertreatment "warm-up" rate was enabled with the use of a flexible valvetrain. Specifically, LEVO at high idle speeds enabled significantly higher engine-out temperatures without sacrificing mass flow or emissions, thereby increasing the exhaust gas-to-catalyst heat transfer rate for catalyst temperatures below 250° C.

Figure 15:
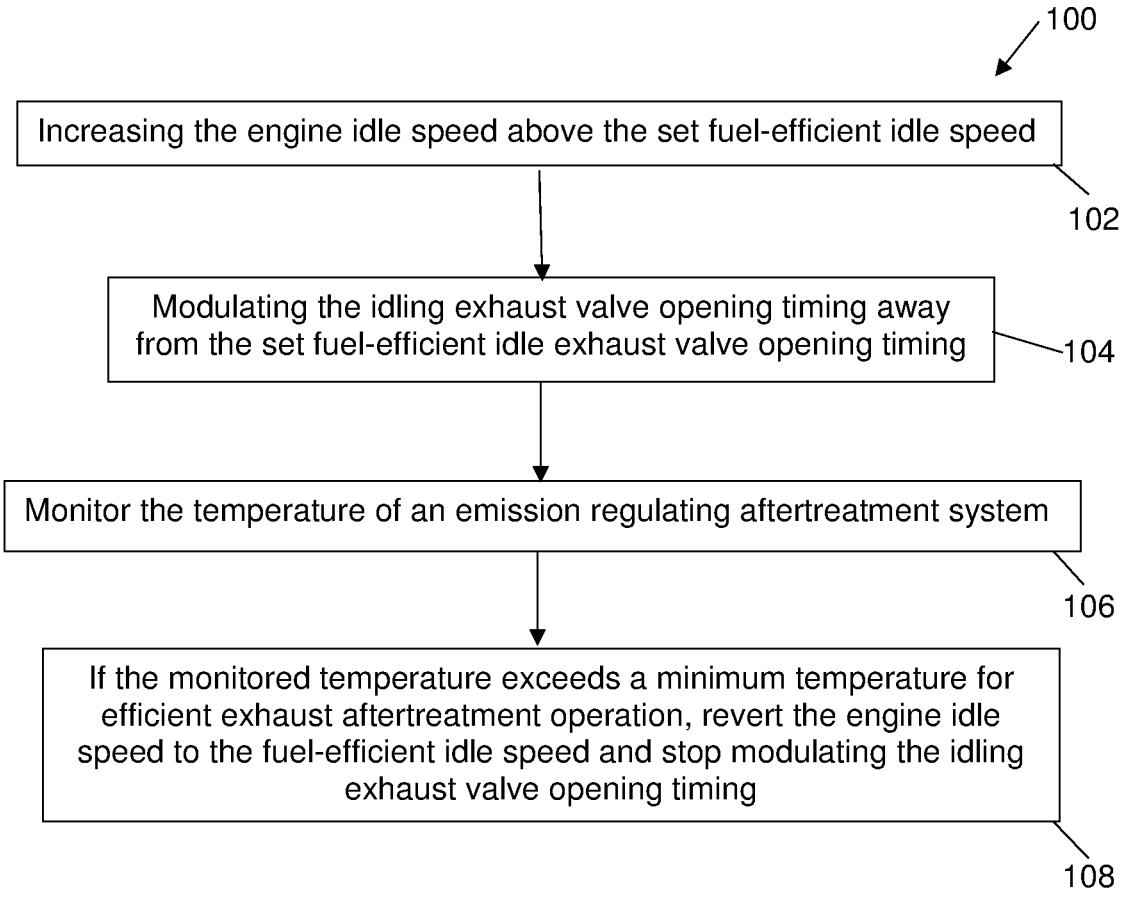
FIG. 15. illustrates a process to improve the warm-up speed of an aftertreatment system.

FIG. 15 illustrates process 100. Process 100 can be used to improve the warm-up speed of an aftertreatment system. Process 100 begins with step 102 where the engine idle speed is increased above a set fuel-efficient idle speed and step 104 where the idling exhaust valve opening timing is modulated away from a set fuel-efficient idle exhaust valve opening timing. Steps 102 and 104 can optionally be followed by steps 106 and 108. In step 106, the temperature of the aftertreatment system is monitored. In step 108, if the monitored temperature exceeds a minimum temperature for efficient exhaust aftertreatment operation, the engine idle speed and the idling exhaust valve opening timing are reverted to the fuel-efficient idle speed and fuel-efficient exhaust valve opening timing.

In process 100, steps 102 and 104, in combination, should increase the idling exhaust flow rate by at least 30% and increases the idling engine outlet temperature by at least 25° C. In some embodiments, steps 102 and 104 in combination could result in an increase in the idling exhaust flow rate by at least 50% and/or an increase in the idling engine out temperature by at least 40° C. or at least 50° C. Steps 102 and 104, in combination, may also increase idling fuel consumption by at least 20%. Steps 102 and 104, in combination, may also increase the idling intake manifold pressure by at least 5 kPa or by at least 8 kPa. Steps 102 and 104, in combination, should not increase exhausted NOx or PM levels compared to fuel-efficient idling. Steps 102 and 104, in combination, may increase cold start exhaust gas-to-catalyst heat transfer rate by at least 50%.

Step 102 may be embodied by increasing a set fuel-efficient idle speed between 750-850 RPM to at least about 1,000 RPM or to at least about 1,200 RPM. Alternately, step 102 may be embodied by increase a set fuel-efficient idle speed to at least 120% of the set fuel-efficient idle speed or to at least 140% of the set fuel-efficient idle speed.

Step 104 may be embodied by setting either early exhaust valve opening timing or late exhaust valve opening timing compared to the set fuel-efficient idle exhaust valve opening timing.

Aftertreatment systems require thermal energy to operate efficiently and effectively. The efforts discussed in this disclosure demonstrate with respect to conventional idle operation (800 RPM and 1.3 bar BMEP) that elevating the idle speed and utilizing exhaust valve opening (EVO) modulation, either individually or combined, are effective strategies at increasing the amount of heat transfer to the aftertreatment system.

In comparison to a conventional six cylinder thermal management baseline calibration (TM Cal. w/o WA at 800 RPM) with four late injections and a maximally closed VGT, elevating the idle speed to 1000 RPM and 1200 RPM realized 31% to 51% increase in exhaust flow and 25° C. to 40° C. increase in engine-out temperature, respectively. Furthermore, NOx and PM for the elevated idle strategies remained no higher than conventional idle operation without utilizing variable valvetrain flexibility.

EVO modulation enabled engine-out temperature benefits without reducing the exhaust flow rate at all three experimentally tested idle speeds (800, 1000, and 1200 RPM). Specifically, at 800 RPM, late EVO enabled a 85° C. increase in engine-out temperature, while maintaining the same exhaust flow rate and emissions as compared to the conventional idle thermal calibration strategy.

High idle speeds combined with early EVO realized up to 31% increase in exhaust flow, 50° C. increase in engine-out temperature, and constrained emissions relative to conventional idle thermal operation by forcing the engine to overcome the lost piston-work via an early blow-down of the exhaust gas. Late EVO realized up to 51% increase in exhaust flow, 91° C. increase in engine-out temperature, and constrained emissions relative to conventional idle thermal operation by reducing the size of the exhaust profile to increase the work needed to pump the gases from the intake to exhaust manifold.

Aftertreatment thermal management is critical for regulating emissions in modern diesel engines. Elevated engine-out temperatures and mass flows are effective at increasing the temperature of an aftertreatment system to enable efficient emissions reduction. Applicants have determined that increasing the idle speed, while maintaining the same idle load, enables improved aftertreatment "warm-up" performance with engine-out NOx and PM levels no higher than a state-of-the-art thermal calibration at conventional idle operation (800 RPM and 1.3 bar BMEP). Elevated idle speeds of 1000 RPM and 1200 RPM, compared to conventional idle at 800 RPM, realized 31% to 51% increase in exhaust flow and 25° C. to 40° C. increase in engine-out temperature, respectively. Applicants also demonstrated additional engine-out temperature benefits at all three idle speeds considered (800, 1000, and 1200 RPM), without compromising the exhaust flow rates or emissions, by modulating the exhaust valve opening (EVO) timing. Early EVO realizes up to ~51% increase in exhaust flow and 50° C. increase in engine-out temperature relative to conventional idle operation by forcing the engine to work harder via an early blow-down of the exhaust gas. This early blow-down of exhaust gas also reduces the time available for PM oxidization, effectively limiting the ability to elevate engine-out temperatures for the early EVO strategy. Alternatively, late EVO realizes up to ~51% increase in exhaust flow and 91° C. increase in engine-out temperature relative to conventional idle operation by forcing the engine to work harder to pump in-cylinder gases across a smaller exhaust valve opening. Increased idle speeds, and EVO modulation, individually or combined, are used to significantly increase the "warm up" rate of an aftertreatment system.

Overall, increased idle speeds, and EVO modulation, individually or combined, can be used to significantly increase the "warm up" rate of an aftertreatment system without emitting higher NOx or PM, compared to a state-of-the-art idle thermal calibration strategy. Increasing the idle speed is an effective way to increase the exhaust gas-to-catalyst heat transfer rate via elevated engine-out mass flows and temperatures. In addition, valvetrain flexibility enabled improvements in engine-out temperatures without reducing the exhaust flow, leading to significantly higher exhaust gas-to-catalyst heat transfer rates.

| Nomenclature | |
|---|---|
| AFR | Air-to-Fuel Ratio |
| BDC | Bottom Dead Center |
| BMEP | Brake Mean Effective Pressure |
| BTE | Brake Thermal Efficiency |
| FC | Fuel Consumption |
| NOx | Oxides of Nitrogen |
| PM | Particulate Matter |
| CAC | Charge Air Cooler |
| CAD | Crank Angle Degree(s) |
| CCE | Closed Cycle Efficiency |
| CDA | Cylinder Deactivation |
| DOC | Diesel Oxidation Catalyst |
| DPF | Diesel Particulate Filter |

-continued

| Nomenclature | |
|---|---|
| ECM | Engine Control Module |
| EEVO | Early Exhaust Valve Opening |
| EGR | Exhaust Gas Re-circulation |
| EIVC | Early Intake Valve Closure |
| EPA | Environmental Protection Agency |
| GSI | Generic Serial Interface |
| HDFTP | Heavy Duty Federal Test Procedure |
| iEGR | Internal Exhaust Gas Re-circulation |
| LEVO | Late Exhaust Valve Opening |
| LFE | Laminar Flow Element |
| LVDT | Linear Variable Differential Transformer |
| ME | Mechanical Efficiency |
| NVO | Negative Valve Overlap |
| OCE | Open Cycle Efficiency |
| PMEP | Pumping Mean Effective Pressure |
| RPM | Revolutions Per Minute |
| SCR | Selective Catalytic Reduction |
| SOI | Start of Injection |
| TOT | Turbine Outlet Temperature |
| UHC | Unburnt Hydrocarbons |
| VGT | Variable Geometry Turbine |
| WA | Variable Valve Actuation |

REFERENCES

[1] United States Environmental Protection Agency. Heavy-duty highway compression-ignition engines and urban buses: Exhaust emission standards. 2010. URL https://nepis.epa.gov/Exe/ZyPDF.cgi? Dockey=P10009ZZ.pdf.

[2] Donald W Stanton. L. Ray Buckendale Lecture 2013-01-2421 2013. 2013.

[3] X Song, H Surenahalli, J Naber, G Parker, et al. Experimental and modeling study of a diesel oxidation catalyst (DOC) under transient and CPF active regeneration conditions. *SAE Technical Paper, doi:*10.4271/2013-01-1046, 2007:10-01.

[4] Stephan Stadlbauer, Harald Waschl, Alexander Schilling, and Luigi del Re. DOC temperature control for low temperature operating ranges with post and main injection actuation. Technical report, SAE Technical Paper, 2013.

[5] Steve Charlton, Thomas Dollmeyer, and Thomas Grana. Meeting the US heavy-duty EPA 2010 standards and providing increased value for the customer. *SAE International Journal of Commercial Vehicles,* 3(1):101-110, 2010.

[6] Xianjun Hou, Yi Ma, Fuming Peng, Fuwu Yan, and Xianan Zhang. Research on temperature characteristics of dpf regeneration technology based on catalytic combustion of fuel injection. In *Power and Energy Engineering Conference* (*APPEEC*), 2010 *Asia-Pacific*, pages 1-4. IEEE, 2010.

[7] Sebastian Gehrke, Dávid Kovacs, Peter Eilts, Alexander Rempel, and Peter Eckert. Investigation of VVA-based exhaust management strategies by means of a HD single cylinder research engine and rapid prototyping systems. *SAE International Journal of Commercial Vehicles,* 6(1): 47-61, 2013.

[8] Pingen Chen and Junmin Wang. Estimation and adaptive nonlinear model predictive control of selective catalytic reduction systems in automotive applications. *Journal of Process Control,* 40:78-92, 2016.

[9] Pingen Chen and Junmin Wang. Control-oriented model for integrated diesel engine and aftertreatment systems thermal management. *Control Engineering Practice,* 22:81-93, 2014.

[10] Roger D. England. Increasing exhaust temperature for aftertreatment operation. 2007. URL https://patents-.google.com/patent/U.S. Pat. No. 7,854,114. U.S. Pat. No. 7,854,114.

[11] Mrunal C. Joshi, Cody M. Allen Dheeraj B. Gosala, Kalen Vos, Matthew Van Voorhis, Alexander Taylor, Gregory M. Shaver, James McCarthy Jr., Dale Stretch, Edward Koeberlein, and Lisa Farrell. Reducing diesel engine drive cycle fuel consumption through use of cylinder deactivation to maintain aftertreatment component temperature during idle and low load operating conditions. *Frontiers in Mechanical Engineering,* 2017. doi: 10.3389/fmech.2017.00008.

[12] Chuan Ding, Leighton Roberts, David J Fain, Aswin K Ramesh, Gregory M Shaver, James McCarthy, Michael Ruth, Edward Koeberlein, Eric A Holloway, and Douglas Nielsen. Fuel efficient exhaust thermal management for compression ignition engines during idle via cylinder deactivation and flexible valve actuation. *International Journal of Engine Research*, page 1468087415597413, 2015.

[13] Dheeraj B. Gosala, Aswin K. Ramesh, Mrunal C. Joshi, Cody M. Allen, Alexander H Taylor, Matthew Van Voorhis, Gregory M. Shaver, Lisa Farrell, Edward Koeberlein, James McCarthy Jr., and Dale Stretch. Diesel engine aftertreatment warm-up through early exhaust valve opening and internal exhaust gas recirculation during idle operation. *International Journal of Engine Research,* 2017. doi: 10.1177/1468087417730240.

[14] Aswin K. Ramesh, Troy E. Odstrcil, Dheeraj B. Gosala, Greg M. Shaver, Soumya Nayyar, Ed Koberlein, and Jim McCarthy Jr. Reverse breathing in diesel engines for aftertreatment thermal management, doi:10.1177/1468087418783118. *International Journal of Engine Research,* 2018.

[15] Aswin K. Ramesh, Dheeraj B. Gosala, Cody Allen, James McCarthy Jr., Lisa Farrell, Edward D. Koeberlein, and Gregory Shaver. Cylinder deactivation for increased engine efficiency and aftertreatment thermal management in diesel engines. *SAE Technical Paper* 2018-01-0384, 2018. doi: 10.4271/2018-01-0384.

[16] Rasoul Salehi and Anna G. Stefanopoulou. Optimal exhaust valve opening control for fast aftertreatment warm up in diesel engines. *American Society of Mechanical Engineers,* 2018.

[17] Kalen R. Vos, Gregory M. Shaver, Aswin K. Ramesh, James McCarthy Jr., and Lisa Farrell. Impact of cylinder deactivation and cylinder cutout via flexible valve actuation on fuel efficient aftertreatment thermal management at curb idle. submitted to *Frontiers in Mechanical Engineering,*

[18] Christopher Sharp, Cynthia C. Webb, Gary Neely, and Ian Smith. Evaluating technologies and methods to lower nitrogen oxide emissions from heavy-duty vehicles. 2017. URL https://www.arb.ca.gov/research/veh-emissions/low.

[19] Christopher Sharp, Cynthia C. Webb, Gary Neely, Michael Carter, Seungju Yoon, and Cary Henry. Achieving ultra low NOx emissions levels with a 2017 heavy-duty on-highway TC diesel engine and an advanced technology emissions system-thermal management strategies. *SAE International Journal Engines,* 10(4), 2017. doi: 10.4271/2017-01-0954.

[20] Kalen R. Vos, Gregory M. Shaver, Mrunal C. Joshi, Aswin K. Ramesh, James McCarthy Jr., and Lisa Farrell. Improving modern diesel engine system aftertreatment thermal management via variable valve actuation without variable geometry turbocharging. *submitted to Frontiers in Mechanical Engineering,*

We claim:

1. A method of increasing heat output of an idling diesel engine to improve a rate of heating of a below optimal temperature emission regulating aftertreatment system, wherein the diesel engine has a set fuel-efficient idle speed and a set fuel-efficient idle exhaust valve opening timing, the diesel engine having an idling exhaust flow rate, an idling engine out exhaust temperature and an idling intake manifold pressure each corresponding to the fuel-efficient idle speed and exhaust valve opening timing, the method comprising:

increasing the engine idle speed above the set fuel-efficient idle speed; and modulating the idling exhaust valve opening timing away from the set fuel-efficient idle exhaust valve opening timing, wherein the combination of increasing the engine idle speed and modulating the exhaust valve opening timing increases the idling exhaust flow rate by at least 30% and increases the idling engine outlet temperature by at least 25° C.

2. The method of claim 1, wherein the combination of increasing the engine idle speed and modulating the exhaust valve opening timing increases the idling exhaust flow rate by at least 50%.

3. The method of claim 1, wherein the combination of increasing the engine idle speed and modulating the exhaust valve opening timing increases the idling engine out temperature by at least 40° C.

4. The method of claim 1, wherein the combination of increasing the engine idle speed and modulating the exhaust valve opening timing increases the idling engine out temperature by at least 50° C.

5. The method of claim 1, wherein the combination of increasing the engine idle speed and modulating the exhaust valve opening timing increases the idle fuel consumption of the engine by at least 20%.

6. The method of claim 1, wherein the combination of increasing the engine idle speed and modulating the idling exhaust valve opening timing increases the idling intake manifold pressure by at least 5 kPa.

7. The method of claim 1, further comprising:

measuring the temperature of the emission regulating aftertreatment system;

if the measured temperature exceeds a minimum temperature for efficient exhaust aftertreatment operation, revert the engine idle speed to the fuel-efficient idle speed and stop modulating the idling exhaust valve opening timing.

8. The method of claim 1, wherein increasing the engine idle speed and modulating the idling exhaust valve opening timing does not increase exhausted NOx or PM levels compared to fuel-efficient idling.

9. The method of claim 1, wherein the idle speed is increased to at least 120% of the set fuel-efficient idle speed.

10. The method of claim 1, wherein the idle speed is increased to at least 140% of the set fuel-efficient idle speed.

11. The method of claim 1, wherein the combination of increasing the engine idle speed and modulating the exhaust valve opening timing increases cold start exhaust gas-to-catalyst heat transfer rate by at least 50%.

12. The method of claim 1 in which said modulating is selected from the group consisting of setting an earlier exhaust valve opening and setting a later exhaust valve opening.

13. The method of claim 12, comprising modulating the exhaust valve opening timing sufficient to increase the exhaust flow rate by at least 50%.

14. The method of claim 12, comprising modulating the exhaust valve opening timing sufficient to increase the engine out temperature by at least 40° C.

15. The method of claim 1, wherein the set fuel-efficient idle speed is between 750-850 RPM, the method comprising increasing the engine idle speed to at least 1,000 RPM.

16. The method of claim 15, wherein modulating the idling exhaust valve opening timing comprises setting early exhaust valve opening timing compared to the set fuel-efficient idle exhaust valve opening timing.

17. The method of claim 15, wherein modulating the idling exhaust valve opening timing comprises setting late exhaust valve opening timing compared to the set fuel-efficient idle exhaust valve opening timing.

18. The method of claim 15, comprising increasing the engine idle speed to at least 1,200 RPM.

19. The method of claim 18, wherein modulating the idling exhaust valve opening timing comprises setting early exhaust valve opening timing compared to the set fuel-efficient idle exhaust valve opening timing.

20. The method of claim 18, wherein modulating the idling exhaust valve opening timing comprises setting late exhaust valve opening timing compared to the set fuel-efficient idle exhaust valve opening timing.

21. The method of claim 18, comprising operating the diesel engine at a higher engine idle speed sufficient to increase the intake manifold pressure by at least 8 kPa above the set intake manifold pressure.

* * * * *